US012181235B2

(12) United States Patent
Smieja et al.

(10) Patent No.: US 12,181,235 B2
(45) Date of Patent: Dec. 31, 2024

(54) BARREL EXTENSION EXTRACTION CAM AND BARREL EXTENSION SYSTEM

(71) Applicant: Gunwerks LLC, Cody, WY (US)

(72) Inventors: Avery Smieja, Cody, WY (US); Aaron Davidson, Cody, WY (US)

(73) Assignee: Gunwerks LLC, Cody, WY (US)

( * ) Notice: Subject to any disclaimer, the term of this patent is extended or adjusted under 35 U.S.C. 154(b) by 36 days.

(21) Appl. No.: 18/200,755

(22) Filed: May 23, 2023

(65) Prior Publication Data

US 2024/0044598 A1 Feb. 8, 2024

Related U.S. Application Data

(60) Provisional application No. 63/345,333, filed on May 24, 2022.

(51) Int. Cl.
*F41A 15/14* (2006.01)
*F41A 21/48* (2006.01)

(52) U.S. Cl.
CPC ..... *F41A 15/14* (2013.01); *F41A 21/482* (2013.01)

(58) Field of Classification Search
CPC ..... F41A 15/14; F41A 15/12; F41A 21/482; F41A 3/22; F41A 3/72
See application file for complete search history.

(56) References Cited

U.S. PATENT DOCUMENTS 3,611,866 A 10/1971 Jacolucci et al.
3,618,457 A 11/1971 Miller
3,631,620 A * 1/1972 Ohira ..... F41A 3/22 42/16
3,653,140 A * 4/1972 Alday ..... F41A 3/20 42/16
4,454,672 A * 6/1984 Timari ..... F41A 3/64 42/16
4,698,931 A * 10/1987 Larsson ..... F41A 3/22 42/16
9,038,303 B1 * 5/2015 Olson ..... F41A 15/14 42/25
10,018,434 B2 7/2018 Daley, Jr.
10,514,219 B2 12/2019 Schafer
(Continued)

OTHER PUBLICATIONS

Sig Cross Operator's Manual: Handling & Safety Instructions, Rev. 2, Sig Sauer, Inc., 2020, 112 pages.
(Continued)

*Primary Examiner* — Joshua E Freeman
(74) *Attorney, Agent, or Firm* — Patterson + Sheridan, LLP

(57) ABSTRACT

Embodiments of the present disclosure generally relate to bolt extraction systems and barrel extension systems for rifles, such as bolt-action rifles. In one or more embodiments, the bolt extraction system includes a bolt and a barrel extension which provide extraction cams and extraction lugs to utilize a screw action while assisting in the removal of the bolt head and a spent cartridge from the barrel extension. In other embodiments, the barrel extension system includes a barrel extension and a firearm receiver with a clamp assembly. The barrel extension has a threaded hole which aligns with an attachment hole disposed on the firearm receiver. A fastener couples the barrel extension to the firearm receiver via the attachment hole and the threaded hole.

20 Claims, 20 Drawing Sheets

(56) References Cited

U.S. PATENT DOCUMENTS

| | | | | |
|---|---|---|---|---|
| 10,533,816 | B2 * | 1/2020 | Schafer | F41A 3/72 |
| 10,578,381 | B2 * | 3/2020 | DiChario | F41A 5/18 |
| 11,181,331 | B2 | 11/2021 | Schafer | |
| 11,754,366 | B2 * | 9/2023 | Hamilton | F41C 9/085 42/51 |
| 2010/0257768 | A1 * | 10/2010 | Barrett | F41A 19/13 42/16 |
| 2012/0137557 | A1 * | 6/2012 | Klotz | F41A 3/72 42/16 |
| 2014/0250751 | A1 * | 9/2014 | Foster | F41A 11/02 42/6 |
| 2018/0045476 | A1 * | 2/2018 | Hamilton | F41A 3/22 |
| 2018/0080733 | A1 * | 3/2018 | Battaglia | F41A 21/484 |
| 2018/0128567 | A1 * | 5/2018 | Foster | F41A 3/30 |
| 2019/0078849 | A1 * | 3/2019 | Schafer | F41A 3/22 |
| 2020/0386495 | A1 * | 12/2020 | Hamilton | F41A 3/18 |
| 2021/0302116 | A1 * | 9/2021 | Shipley | F41A 3/26 |
| 2022/0099391 | A1 * | 3/2022 | Koehler | F41A 3/22 |
| 2022/0136788 | A1 * | 5/2022 | Caudle | F41A 11/02 42/18 |
| 2022/0146222 | A1 * | 5/2022 | Eggert | F41A 7/08 |
| 2022/0146223 | A1 * | 5/2022 | Eggert | F41A 7/08 |

OTHER PUBLICATIONS

Rob Curtis, SIG Cross Rifle: SIG Returns to the Bolt Action Market, Recoil, The Ultimate Firearms Destination for the Gun Lifestyle [online], https://www.recoilweb.com/sig-cross-rifle-sig-returns-to-the-bolt-action-market-155231.html, published Dec. 18, 2019, 7 pages.

* cited by examiner

BARREL EXTENSION EXTRACTION CAM AND BARREL EXTENSION SYSTEM

CROSS-REFERENCE TO RELATED APPLICATIONS

This application claims benefit to U.S. Prov. Appl. No. 63/345,333, filed on May 24, 2022, which is herein incorporated by reference.

BACKGROUND

Field

Embodiments of the present disclosure generally relate to firearms. In particular, embodiments described herein relate to a bolt extraction system and a barrel extension system for bolt-action rifles.

Description of the Related Art

A bolt-action rifle is a type of rifle with an action in which the bolt is operated manually by the opening and closing of the breech by a bolt handle. As the handle is operated, the bolt rotates and is unlocked, the breech is opened, a spent shell casing may be withdrawn and ejected, and finally, a new round is fed into the breech and the bolt is closed. Bolt-action firearms have earned a reputation for being more accurate and reliable than typical semi-automatic rifles. For this reason, they are often the choice rifle of many long-range precision target shooters and hunters, as well as military and law enforcement snipers.

Optimum center fire shell casing accuracy design utilizes a tight breech condition in that when the bolt face is locked in battery, the bolt face cannot move rearward upon ignition, thereby supporting the shoulder of the shell casing and insuring contact of the shell casing shoulder to the breech supporting the centrality of the neck of the case at time of ignition. The slightest rearward movement or loss of headspace of the shell casing away from the breech neck wall can result in off center ignition allowing the projectile to offload on its imprint into the rifling of the barrel. The resultant off-center ignition and projectile seating will cause loss of accuracy at distance. Precision bolt-action rifles do not have this concern because the bolt face is locked in the head space.

However, for many of the same reasons bolt-action rifles benefit by having precision and accuracy, bolt-action rifles can suffer spent shell casings being stuck in the breech and difficult to remove. Once shot, the spent shell casing is typically expanded and further form fitted against the inner surfaces of the breech or chamber. The bolt handle must be lifted upward rotating the bolt before pulling straight back to start the extraction of the bolt head and the spent shell casing attached to the bolt head via an extractor. An excessive amount of force may have to be applied while lifting the bolt handle upward and pulling the bolt handle backwards to remove the expanded spent shell casing. Damage can occur to the bolt handle, the rifle receiver which the bolt handle contacts, the overall bolt, and/or the extractor during the extraction process of a stuck shell casing. Damage to the rifle receiver is even more likely if the receiver is made from aluminum instead of steel due to the greater softness of aluminum.

Therefore, there is a need for an improved system to extract the bolt and spent shell casing from the breech of a rifle. There is also a need for an improved barrel extension system which utilizes a barrel extension to align with and couple to a firearm receiver.

SUMMARY

Embodiments of the present disclosure generally relate to a bolt extraction system for rifles, such as bolt-action rifles. The bolt extraction systems described and discussed herein provide extraction cams and extraction lugs which utilize a screw action to assist in the removal of the bolt head from the breech, such as a barrel extension. The bolt head and the spent shell casing attached to the bolt face are removed from the barrel extension with less force and therefore provides less damage to various rifle components compared to traditional bolt-action systems.

In one or more embodiments, a bolt extraction system for bolt-action rifles is provided and includes a bolt and a barrel extension. The bolt contains a bolt head coupled to and axially aligned with a bolt tail at an interface. The bolt head has a bolt face, the bolt tail has a tail surface, and the bolt face is opposite of the tail surface. The bolt further contains a plurality of bolt head lugs and a plurality of extraction lugs. The plurality of bolt head lugs is circumferentially and equally disposed around the bolt head and separated by gaps. Each of the bolt head lugs contains a front surface opposite a rear surface and a first side surface opposite a second side surface. The plurality of extraction lugs is circumferentially and equally disposed around the bolt head at the interface. Each of the extraction lugs has a front surface opposite a rear surface and a first side surface opposite a second side surface. Also, each of the extraction lugs is circumferentially aligned with a respective gap disposed between each pair of the bolt head lugs. The barrel extension contains a passageway extending from a front side to a rear side of the barrel extension. The passageway at the front side is configured to accept a firearm barrel and the passageway at the rear side is configured to accept the bolt head. The barrel extension further a plurality of rear barrel extension lugs circumferentially and equally disposed on an inner surface of the barrel extension within the passageway. Each of the rear barrel extension lugs contains a front surface, a rear surface, an extraction cam surface, and a first side surface opposite a second side surface.

In some embodiments, a bolt extraction system for bolt-action rifles is provided and contains a bolt and a barrel extension. The bolt contains a bolt head coupled to and axially aligned with a bolt tail at an interface. The bolt head contains a bolt face which is forward facing. The bolt face is opposite of the tail surface of the bolt tail. The bolt further contains a plurality of bolt head lugs and a plurality of extraction lugs. The plurality of bolt head lugs is circumferentially disposed around the bolt head and separated by gaps. Each of the bolt head lugs contains a front surface opposite a rear surface and a first side surface opposite a second side surface. The plurality of extraction lugs is circumferentially disposed around the bolt head. Each of the extraction lugs has an engagement surface which is forward facing and each of the extraction lugs is circumferentially aligned with a respective gap disposed between each pair of the bolt head lugs. The barrel extension has a passageway extending from a front side to a rear side of the barrel extension. The passageway at the front side is configured to accept a firearm barrel and the passageway at the rear side is configured to accept the bolt head. The barrel extension further contains a plurality of barrel extension lugs circumferentially disposed on an inner surface of the barrel extension within the passageway. Each of the barrel extension lugs contains an extraction cam surface which is rear facing and each of the extraction cam surfaces is circumferentially angled from the rear side towards the front side of the barrel extension.

In other embodiments, the bolt head is configured to be inserted into the passageway from the rear side of the barrel extension while in an out-of-battery position and the bolt head is configured to be locked into the passageway of the barrel extension while in a battery position. The extraction lugs are configured to engage the extraction cam surfaces while the bolt head is in the out-of-battery position. The extraction lugs are configured to slide along the extraction cam surfaces while the bolt head is rotated between the out-of-battery position and the battery position. The extraction lugs are configured to disengage the extraction cam surfaces once the bolt head is in the battery position. The bolt head is configured to be locked into the passageway of the barrel extension once the rear surfaces of the bolt head lugs are engaged to the front surfaces of the rear barrel extension lugs.

In some embodiments, a rifle, such as a bolt-action rifle, is provided and includes a receiver, a barrel, a barrel extension coupled to the receiver and the barrel, and a bolt assembly disposed in the receiver and containing a bolt. The bolt and the barrel extension are contained with the bolt extraction system described and discussed herein.

Embodiments of the present disclosure also generally relate to barrel extension systems for rifles, such as bolt-action rifles. The barrel extension system described and discussed herein provides a barrel extension which easily aligns with and couples to a firearm receiver, such as on rifles. The firearm receiver includes a clamp assembly for coupling with the barrel extension while providing a quick, precise, and accurate option for mounting a barrel to the firearm receiver.

In one or more embodiments, a barrel extension system for bolt-action rifles is provided and includes barrel extension and the firearm receiver. The barrel extension contains a passageway extending from a front side to a rear side of the barrel extension. The passageway at the front side is configured to accept a firearm barrel and the passageway at the rear side is configured to accept a bolt head. The barrel extension further includes a plurality of rear barrel extension lugs and a threaded hole. The plurality of rear barrel extension lugs is circumferentially disposed on an inner surface of the barrel extension within the passageway. Each of the rear barrel extension lugs contains a front surface, a rear surface, and a first side surface opposite a second side surface. The threaded hole is disposed on a lower portion of the barrel extension and extending from the inner surface of the barrel extension to an outer surface of the barrel extension. The firearm receiver contains a passageway extending from a front side to a rear side of the firearm receiver. The passageway at the front side is configured to accept the barrel extension and the passageway at the rear side is configured to accept a bolt assembly. The firearm receiver further contains a clamp assembly and an attachment hole. The clamp assembly is disposed on a lower portion of the firearm receiver and disposed at the front side of the firearm receiver. The attachment hole is disposed on the lower portion of the firearm receiver, disposed between the clamp assembly and the rear side of the firearm receiver, and extends from an inner surface of the firearm receiver to an outer surface of the firearm receiver. The attachment hole and the threaded hole align with one another when the barrel extension is positioned within the passageway at the front side of the firearm receiver.

In some examples, a fastener is configured to attach the barrel extension to the firearm receiver. The fastener, such as a bolt or a screw, passes through the attachment hole and screws into the threaded hole for attaching the barrel extension to the firearm receiver. In other configurations, the barrel extension contains one or more alignment notches disposed on the rear side of the barrel extension and utilized to align the barrel extension into the desired timing or position relative to the firearm receiver.

In some embodiments, a rifle, such as a bolt-action rifle, is provided and includes a firearm receiver, a barrel extension coupled to the firearm receiver, and a barrel coupled to the barrel extension. The firearm receiver and the barrel extension are contained with the barrel extension system and/or the bolt extraction system described and discussed herein.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

Figure 1A:
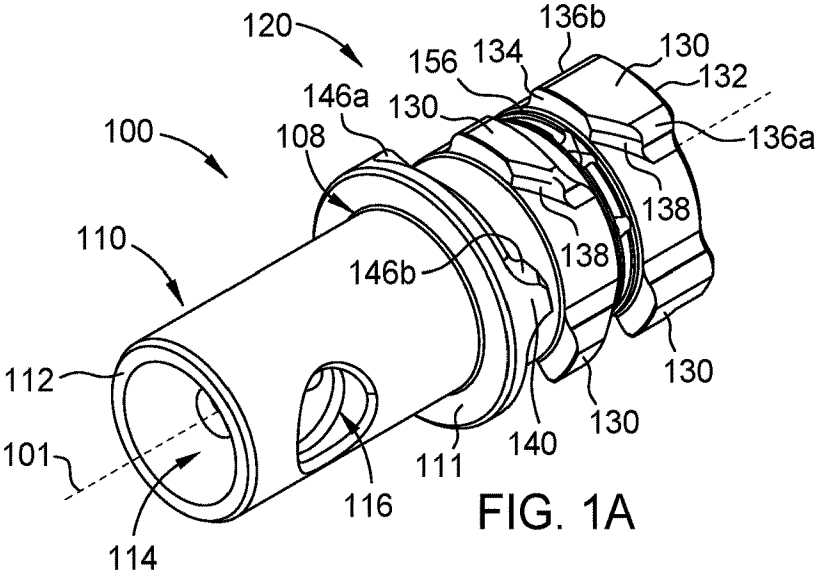
FIG. 1A depicts a perspective view of a bolt, according to one or more embodiments described and discussed herein.

To facilitate understanding, identical reference numerals have been used, where possible, to designate identical elements that are common to the figures. It is contemplated that elements and features of one embodiment may be beneficially incorporated in other embodiments without further recitation. Many of the details, dimensions, angles and other features shown in the Figures are merely illustrative of particular embodiments. Accordingly, other embodiments can have other details, components, dimensions, angles and features without departing from the spirit or scope of the present disclosure. In addition, further embodiments of the disclosure can be practiced without several of the details described below.

DETAILED DESCRIPTION

Embodiments of the present disclosure generally relate to a bolt extraction system for rifles, such as bolt-action rifles. The bolt extraction system described and discussed herein provides extraction lugs on the bolt and extraction cams on the barrel extension which together utilize a screw action to assist in the removal of the bolt head from the barrel extension or otherwise breech of the rifle. The bolt head and the spent shell casing attached to the bolt face are easily removed from the barrel extension without damaging rifle components by the bolt extraction system. Certain details are set forth in the following description and in FIGS. 1A-9C to provide a thorough understanding of various embodiments of the disclosure.

Figure 1I:
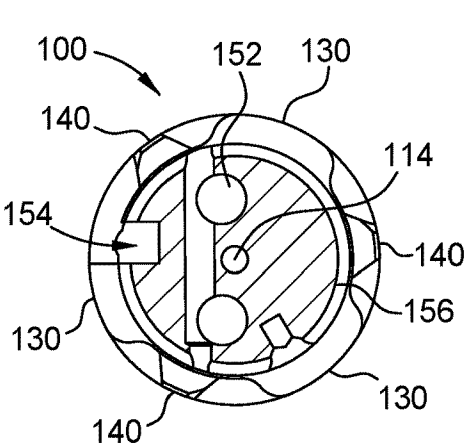
FIG. 1I depicts a cross-sectional view of the bolt, taken along line 1I-1I in FIG. 1G, according to one or more embodiments described and discussed herein.
Figure 1B:
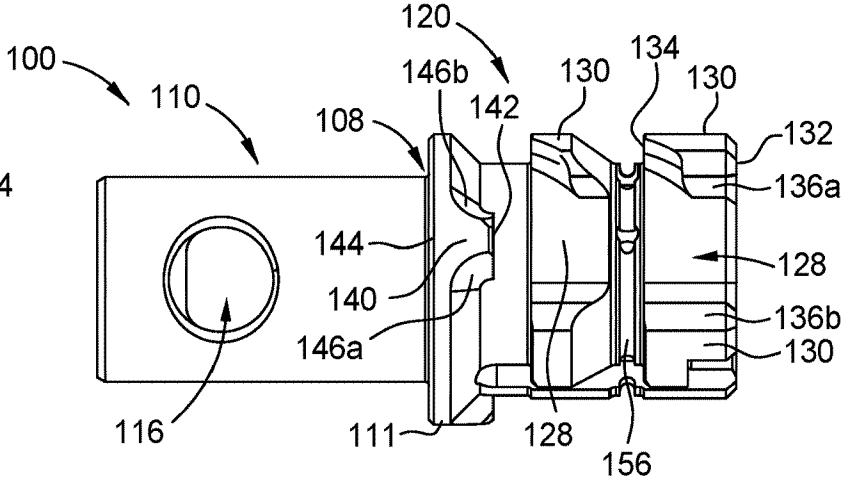
FIG. 1B depicts a side view of the bolt shown in FIG. 1A, according to one or more embodiments described and discussed herein.
Figure 1C:
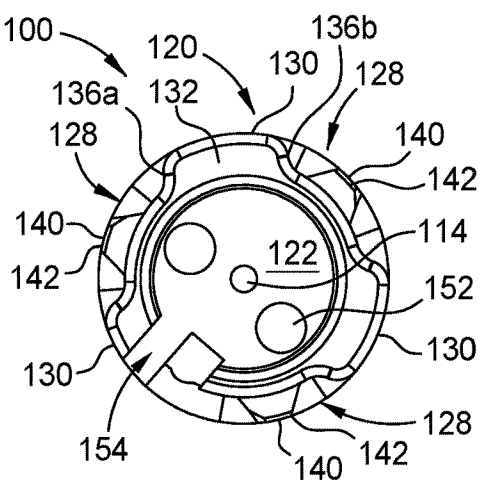
FIG. 1C depicts a front view of the bolt shown in FIG. 1A, according to one or more embodiments described and discussed herein.
Figure 1D:
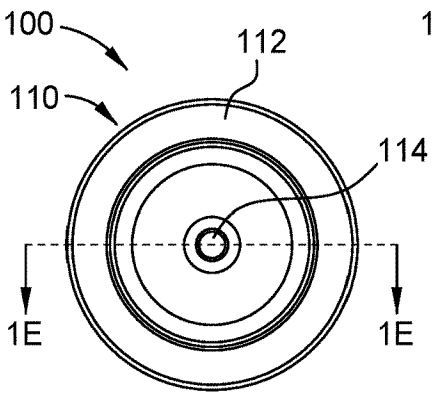
FIG. 1D depicts a rear view of the bolt shown in FIG. 1A, according to one or more embodiments described and discussed herein.
Figure 1E:
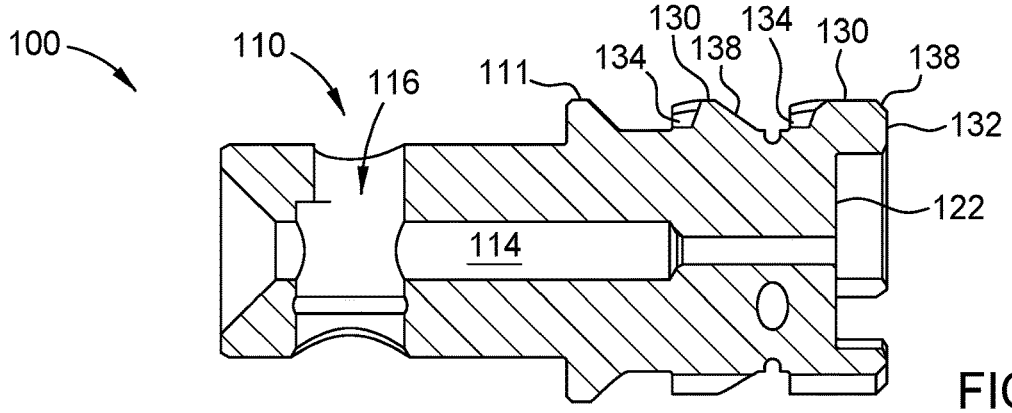
FIG. 1E depicts a cross-sectional view of the bolt, taken along line 1E-1E in FIG. 1D, according to one or more embodiments described and discussed herein.
Figure 1F:
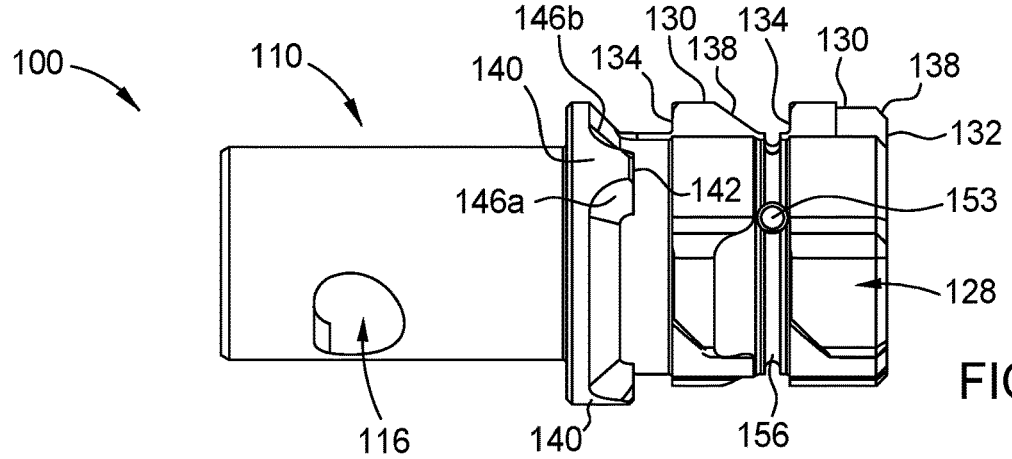
FIGS. 1F-1G depict additional side views of the bolt shown in FIG. 1A, according to one or more embodiments described and discussed herein.
Figure 1G:
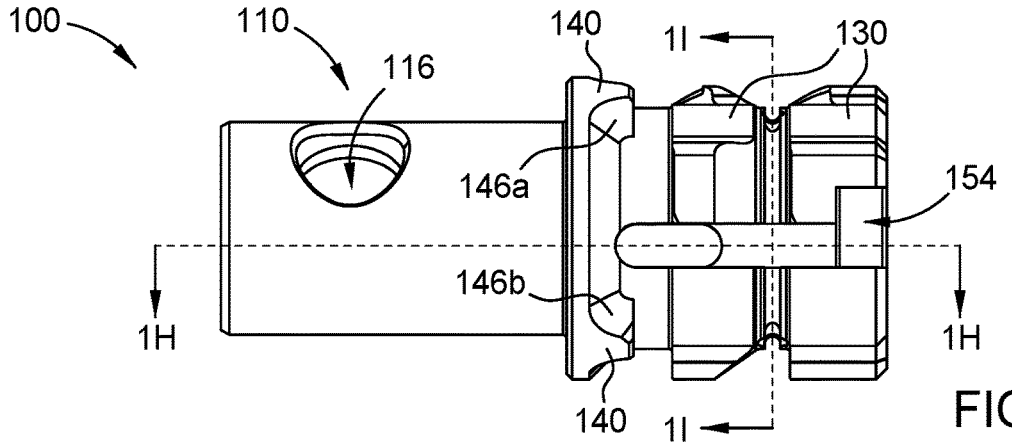
Figure 1H:
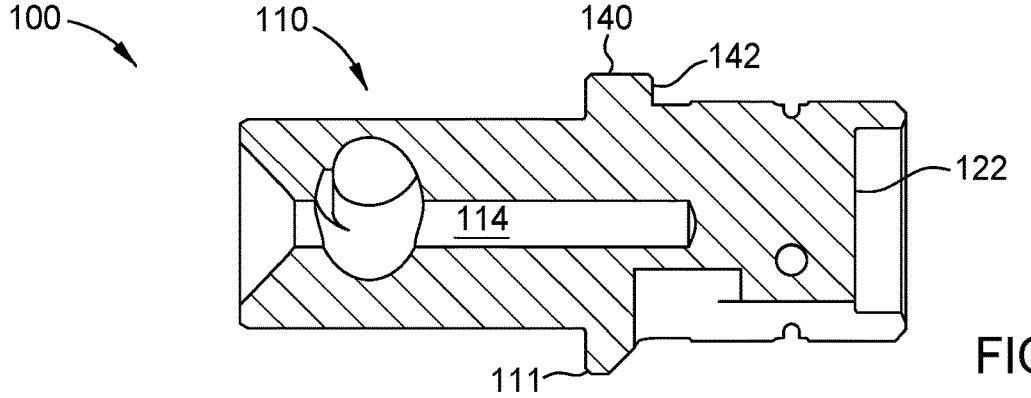
FIG. 1H depicts a cross-sectional view of the bolt, taken along line 1H-1H in FIG. 1G, according to one or more embodiments described and discussed herein.

In a basic configuration, the bolt extraction system includes a bolt 100 (depicted in FIGS. 1A-1I) and a barrel extension 200 (depicted in FIGS. 2A-2G), according to embodiments described and discussed herein. FIG. 1A depicts a perspective view of the bolt 100, FIG. 1B depicts a side view of the bolt 100, FIG. 1C depicts a front view of the bolt 100, and FIG. 1D depicts a rear view of the bolt 100, according to one or more embodiments described and discussed herein. FIG. 1E depicts a cross-sectional view of the bolt 100, taken along line 1E-1E in FIG. 1D. FIGS. 1F and 1G depict additional side views of the bolt 100. FIG. 1H depicts a cross-sectional view of the bolt 100, taken along line 1H-1H in FIG. 1G. FIG. 1I depicts a cross-sectional view of the bolt 100, taken along line 1I-1I in FIG. 1G. The bolt 100 can contain or be made of one or more metals, such as iron, steel, stainless steel, carbon steel, tool steel, carpenter steel, titanium, titanium alloy, alloys thereof, or any combination thereof.

The bolt 100 contains a bolt head 120 coupled to and axially aligned with a bolt tail 110 at an interface 108. The bolt head 120 is in the front of the bolt 100 and the bolt tail 110 is in the rear of the bolt 100. The bolt 100 has a central axis 101 which is common for the bolt head 120 and the bolt tail 110. The bolt head 120 has a bolt face 122 (FIG. 1C) and the bolt tail 110 has a tail surface 112 (FIG. 1D). The bolt face 122 is opposite of the tail surface 112 such that the bolt face 122 is a front facing surface of the bolt 100 and the tail surface 112 is a rear facing surface of the bolt 100.

The bolt head 120 further contains a plurality of bolt head lugs 130 and a plurality of extraction lugs 140. The plurality of bolt head lugs 130 is circumferentially and equally disposed around the bolt head 120 and separated by gaps 128. Each of the bolt head lugs 130 contains a front surface 132 opposite a rear surface 134 and a first side surface 136*a* opposite a second side surface 136*b* (collectively, side surfaces 136). Each of the bolt head lugs 130 further contains an engagement cam surface 138 coupled to and between the rear surface 134 and one of the side surfaces 136 (shown as first side surface 136*a*), as depicted in FIG. 1A.

As shown in the Figures, there are two rows of the bolt head lugs 130. However, in other embodiments not shown, there can be a single row (one row) or three rows of the bolt head lugs 130. Both the first row and second row of the bolt head lugs 130 are circumferentially and equally disposed around the bolt head 120. The first row of the bolt head lugs 130 is the front row and encircles the bolt face 122. The second row of the bolt head lugs 130 is the rear row and closer to the interface 108. Each of the bolt head lugs 130 in the second row is aligned with a respective bolt head lug 130 in the first row and positioned further from the bolt face 122 than the respective bolt head lug 130 in the first row.

In one or more embodiments, not shown, the plurality of bolt head lugs 130 contains a third row of the bolt head lugs 130 circumferentially and equally disposed around the bolt head 120. Each of the bolt head lugs 130 in the third row is aligned with a respective bolt head lug 130 in the second row and positioned further from the bolt face 122 than the respective bolt head lug 130 in the second row.

Although each row of the bolt head lugs 130 can independently have any number of the bolt head lugs 130, each row typically has the same number of the bolt head lugs 130. Each row of the bolt head lugs 130 can have two, three, four, five, six, seven, eight, nine, or ten bolt head lugs 130. As shown in the Figures, the bolt 100 contains two rows and each row contains three of the bolt head lugs 130. In one or more examples, each row of bolt head lugs has two, three, or four bolt head lugs 130.

The plurality of extraction lugs 140 is circumferentially and equally disposed around the bolt head 120 at or near the interface 108. Each of the extraction lugs 140 has a front surface 142 (also known as the engagement surface) opposite a rear surface 144 and a first side surface 146*a* opposite a second side surface 146*b* (collectively, side surfaces 146). In one or more embodiments, the first side surface 146*a* and the second side surface 146*b* on each of the extraction lugs 140 outwardly expands from the front or engagement surface 142 to the rear surface 144 on each of the extraction lugs 140. Also, each of the extraction lugs 140 is circumferentially aligned with a respective gap 128 disposed between each pair of the bolt head lugs 130. Although shown in the Figures with three of the extraction lugs 140, the bolt 100 can have one, two, three, four, or more extraction lugs 140.

In one or more embodiments, the plurality of extraction lugs 140 is coupled to a blast ring or a bolt ring 111 which encircles the bolt 100 at the interface 108. The bolt ring 111 is used to close the backside of the breech once the bolt 100 is locked into battery with the barrel extension 200. In other embodiments, the plurality of extraction lugs 140 can be independent and be positioned in front of the bolt ring 111 (not shown). In some embodiments, the bolt 100 does not contain the bolt ring and the extraction lugs 140 are positioned circumferentially and equally disposed around the bolt head 120 and aligned with a respective gap 128 disposed between each pair of the bolt head lugs 130.

The bolt 100 contains a variety of holes, passageways, slots, and grooves used by components of the bolt assembly 500 and the action assembly 600 further described and discussed below. The bolt 100 has a cam pin hole 116 formed in the bolt tail 110 and used to secure the bolt 100 to a bolt carrier by a cam pin. The bolt 100 further contains a firing pin passageway 114 axially extending from the bolt face 122 to the tail surface 112 along the central axis 101. A firing pin passes through the firing pin passageway 114 within an action assembly containing the bolt 100.

The bolt 100 contains a one, two, or more ejector holes 152 (two ejector holes are shown in FIGS. 1C and 1I). The ejector holes 152 extend from the bolt face 122 into the body of the bolt head 120. An ejector pin hole 153 extends through the bolt head 120, as shown in FIG. 1F. An ejector pin is disposed within the ejector pin hole 153 to secure the ejectors to the bolt 100. The bolt 100 also contains an extractor slot 154 and a ring spring groove 156 formed in the bolt head 120. An extractor sets within the extractor slot 154 and a ring spring sets within the ring spring groove 156 to secure the extractor to the bolt 100.

Figure 2A:
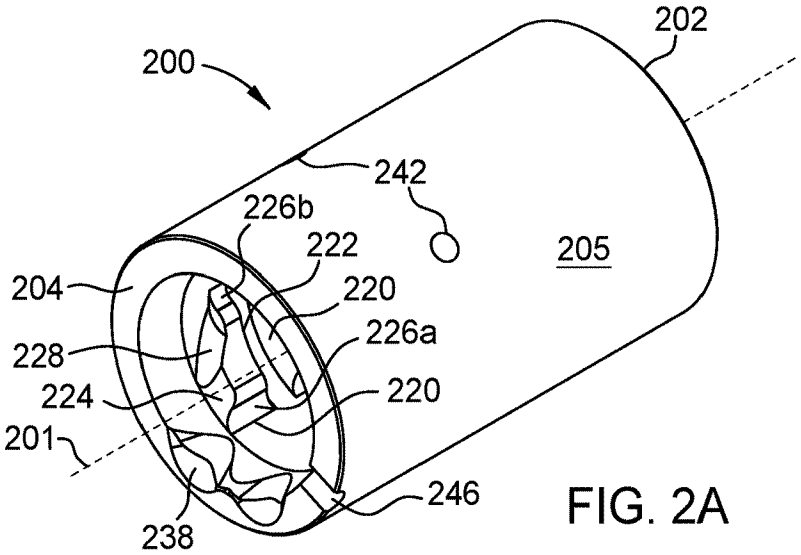
FIG. 2A depicts a perspective view of a barrel extension, according to one or more embodiments described and discussed herein.
Figure 2D:
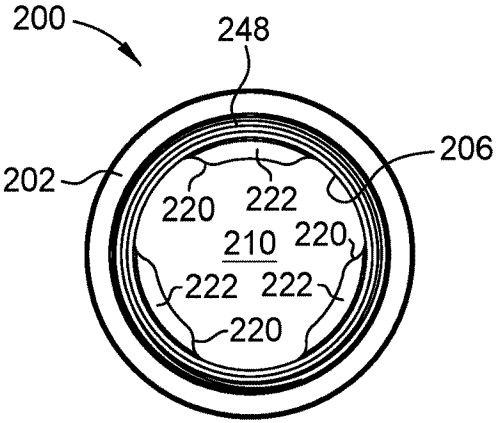
FIG. 2D depicts a rear view of the barrel extension shown in FIG. 2A, according to one or more embodiments described and discussed herein.
Figure 2C:
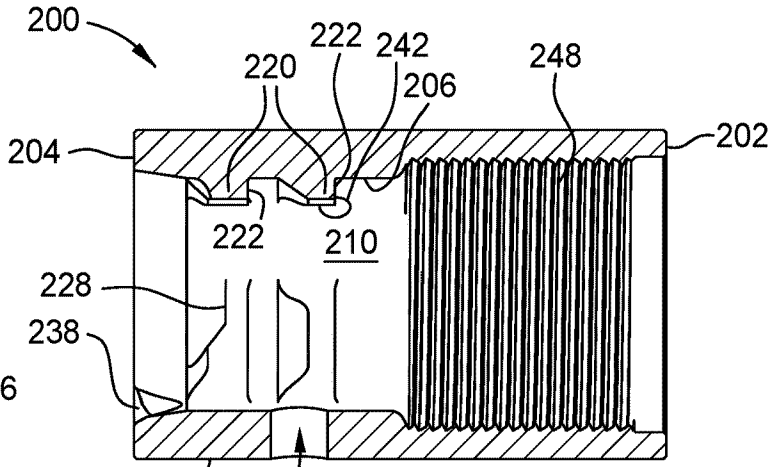
FIG. 2C depicts a cross-sectional view of the barrel extension, taken along line 2C-2C in FIG. 2B, according to one or more embodiments described and discussed herein.
Figure 2B:
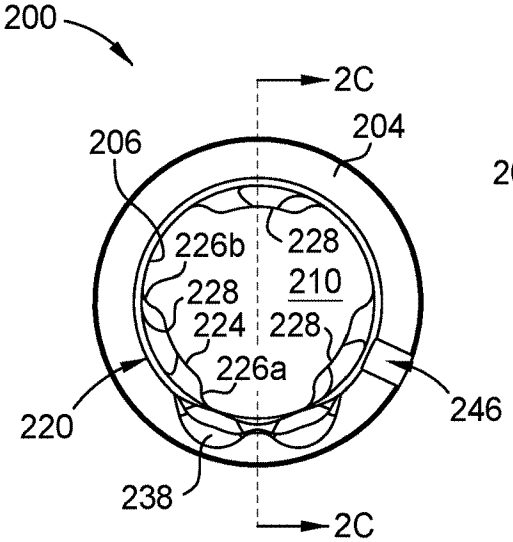
FIG. 2B depicts a front view of the barrel extension shown in FIG. 2A, according to one or more embodiments described and discussed herein.
Figure 2G:
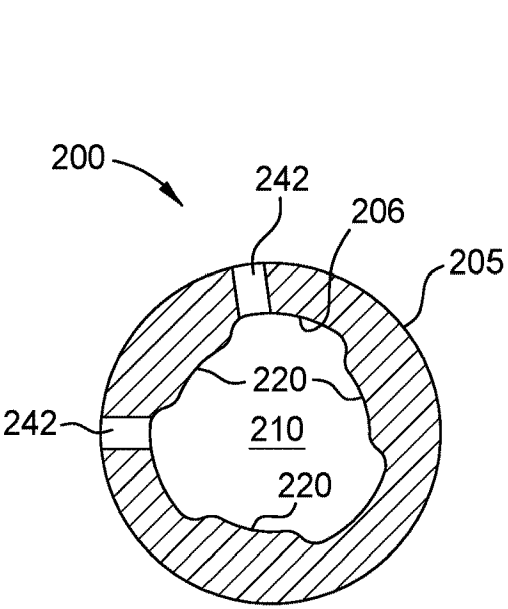
FIG. 2G depicts a cross-sectional view of the barrel extension, taken along line 2G-2G in FIG. 2F, according to one or more embodiments described and discussed herein.
Figure 2F:
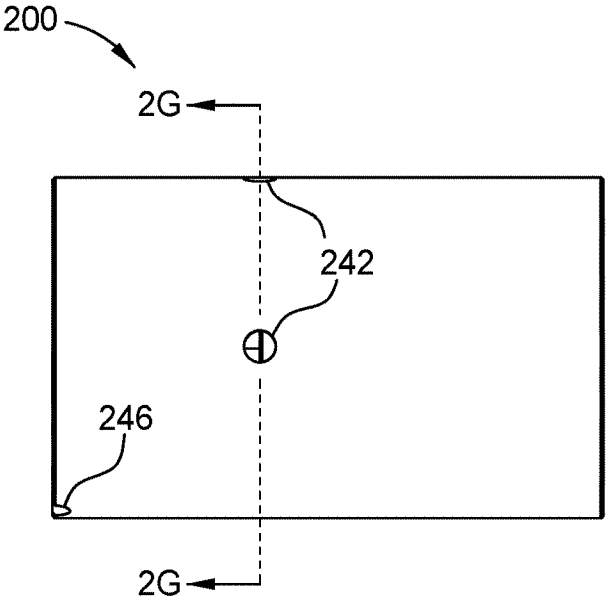
FIG. 2F depicts a top view of the barrel extension shown in FIG. 2A, according to one or more embodiments described and discussed herein.
Figure 2E:
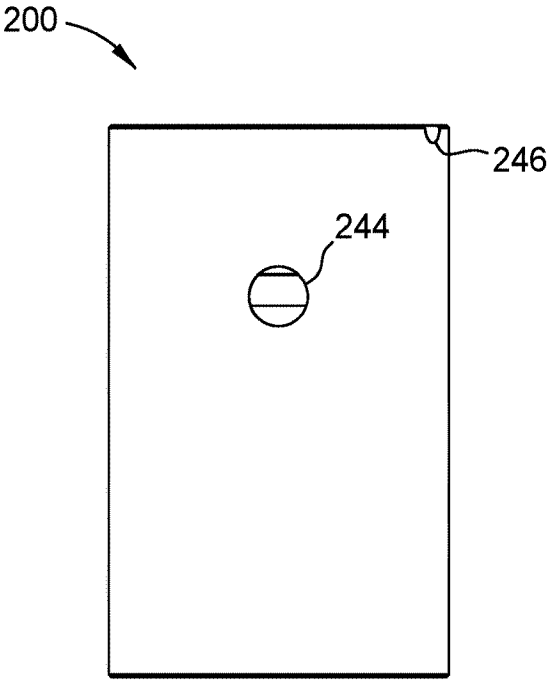
FIG. 2E depicts a bottom view of the barrel extension shown in FIG. 2A, according to one or more embodiments described and discussed herein.

FIG. 2A depicts a perspective view of a barrel extension 200 and FIG. 2B depicts a front view of the barrel extension 200, according to one or more embodiments described and discussed herein. FIG. 2C depicts a cross-sectional view of the barrel extension 200, taken along line 2C-2C in FIG. 2B. FIG. 2D depicts a rear view of the barrel extension 200, FIG. 2E depicts a bottom view of the barrel extension 200, and FIG. 2F depicts a top view of the barrel extension 200. FIG. 2G depicts a cross-sectional view of the barrel extension 200, taken along line 2G-2G in FIG. 2F. The barrel extension 200 can contain or be made of one or more metals, such as iron, steel, stainless steel, carbon steel, tool steel, carpenter steel, titanium, titanium alloy, alloys thereof, or any combination thereof.

The barrel extension 200 has a central axis 201 and contains a passageway 210 extending from a front side 202 to a rear side 204 of the barrel extension 200. The passageway 210 at the front side 202 is configured to accept a firearm barrel (e.g., threading 248) and the passageway 210 at the rear side 204 is configured to accept the bolt head 120. For example, an inner surface 206 of the passageway 210 of the barrel extension 200 adjacent the front side 202 can be threaded to accept a firearm barrel. Other means for coupling a barrel to the barrel extension 200 are further described and discussed below. The barrel extension 200, such as the outer surface, is depicted in the Figures as having a cylindrical geometry or shape. The barrel extension 200 can have other shapes or geometries, such as rectangular or various irregular shapes (not shown).

The barrel extension 200 further includes a plurality of barrel extension lugs 220 circumferentially and equally disposed on the inner surface 206 of the barrel extension 200 within the passageway 210. Each of the barrel extension lugs 220 contains a front surface 222, a rear surface 224, and a first side surface 226*a* opposite a second side surface 226*b* (collectively, side surfaces 226).

As shown in the Figures, there are two rows of the barrel extension lugs 220. However, in other embodiments not shown, there can be a single row (one row) or three rows of the barrel extension lugs 220. Typically, the barrel extension 200 has the same number rows of the bolt head lugs 130 as the bolt 100 has rows of the bolt head lugs 130. Both the first row and second row of the barrel extension lugs 220 are circumferentially and equally disposed around the inner surface 206 of the barrel extension 200.

The first row of the barrel extension lugs 220 is the rear row and is closest to the rear side 204 of the barrel extension 200. The second row of the barrel extension lugs 220 is the front side 202 of the barrel extension 200. Each of the barrel extension lugs 220 in the second row is aligned with a respective the barrel extension lugs 220 in the first row and positioned further from the rear side 204 of the barrel extension 200 than the respective barrel extension lugs 220 in the first row.

Although each row of the barrel extension lugs 220 can independently have any number of the barrel extension lugs 220, each row typically has the same number of the barrel extension lugs 220. Each row of the barrel extension lugs 220 can have two, three, four, five, six, seven, eight, nine, or ten barrel extension lugs 220. As shown in the Figures, the barrel extension 200 contains two rows and each row contains three of the barrel extension lugs 220. In one or more examples, each row of barrel extension lugs has two, three, or four barrel extension lugs 220.

Each of the barrel extension lugs 220 in the rear row, also referred to as the rear barrel extension lugs 220, further contains the extraction cam surface 228. The extraction cam surface 228 is the contact surface for the extraction lug 140 on the bolt 100. The extraction cam surface 228 can extend from the front surface 222 to one of the side surfaces 226. As shown in FIG. 2A, the extraction cam surface 228 extends from the front surface 222 to the side surfaces 226*b*. In other embodiments not shown, the extraction cam surface 228 can be replace all or a portion of the front surface 222 and all or a portion of either of the side surfaces 226.

In one or more embodiments, each of the rear barrel extension lugs 220 contains the front surface 222, the rear surface 224, the extraction cam surface 228, and the first side surface 226*a* opposite the second side surface 226*b*. Each of the extraction cam surfaces 228 is circumferentially angled from the front surface 222 of the rear barrel extension lug 220 toward the rear surface 224 of the rear barrel extension lug 220 or toward the first or second side surface 226 of the rear barrel extension lug 220.

Each of the barrel extension lugs 220 in the front row, also referred to as the front barrel extension lugs 220 typically lack the extraction cam surface 228 since they are relatively behind the rear barrel extension lugs 220 relative to the extraction lugs 140. In one or more embodiments, the plurality of front barrel extension lugs 220 circumferentially and equally disposed on the inner surface 206 of the barrel extension 200 within the passageway 210. Each of the front barrel extension lugs 220 contains the front surface 222 opposite the rear surface 224 and the first side surface 226*a* opposite the second side surface 226*b*.

In other embodiments, not shown, the plurality of front barrel extension lugs 220 contains a second row of the front barrel extension lugs 220 circumferentially and equally disposed around the inner surface 206 of the barrel extension 200 within the passageway 210. Each of the front barrel extension lugs 220 in the second row is aligned with a respective front barrel extension lugs 220 in the first row.

In other embodiments, a feed ramp 238 can be disposed on a lower or bottom portion of the rear side 204 of the barrel extension 200. The feed ramp 238 extends from the inner surface 206 of the barrel extension 200 within the passageway 210. The feed ramp 238 is configured to accept live cartridges while being loaded into the breech of the rifle. In some embodiments, one, two, or more vent holes 242 extend through inner surface 206 to an outer surface 205 of a sidewall of the barrel extension 200, as depicted in FIGS. 2A and 2F-2G. The one or more vent holes 242 provide fluid communication between the passageway 210 and the ambient or outside of the barrel extension 200 and vent or otherwise pass gas through the holes (e.g., vent holes 615) in the receiver (e.g., firearm receiver 610). The vent holes 242 can provide an exhaust path for excess gas generated in the chamber or breech when firing the rifle. The vent holes 242 are particularly useful when an overcharged round is discharged in the chamber and the excess gas can be removed before the chamber is over-pressurized and damaged.

The barrel extension 200 also contains one, two, three, or more attachment holes 244 (e.g., threaded holes) and/or one, two, three, or more attachment or alignment notches 246 (FIGS. 2A and 2C) which extend through the inner surface 206 of a sidewall of the barrel extension 200. One, two, or more fasteners (e.g., screws, bolts, pins) can be used to attach or otherwise couple the barrel extension 200 to a firearm receiver (e.g., rifle receiver). For example, a fastener can be passed through each hole in the firearm receiver and screw into a respective attachment or threaded hole 244 to couple the barrel extension 200 to the firearm receiver. In some examples, the attachment or alignment notch 246 mates or otherwise lines-up and contacts a pin (not shown) extending from an inner surface 613 of the firearm receiver 610.

FIGS. 3A-3E depict a bolt extraction system 300 containing the bolt 100 and the barrel extension 200 at different intervals of engaging each other. FIG. 4 is a flow chart illustrating a method 400 of the movement of the bolt 100 while engaging the barrel extension 200 at the different intervals illustrated in FIGS. 3A-3E, according to one or more embodiments described and discussed herein.

The bolt head 120 is configured to be inserted into the passageway 210 of the barrel extension 200 from the rear side 204 of the barrel extension 200 while in an out-of-battery position and the bolt head 120 is configured to be locked into the passageway 210 of the barrel extension 200 while in a battery position. The extraction lugs 140 are configured to engage the extraction cam surfaces 228 while the bolt head 120 is in the out-of-battery position. The extraction lugs 140 are configured to slide along the extraction cam surfaces 228 while the bolt head 120 is rotated between the out-of-battery position and the battery position. The extraction lugs 140 and the extraction cam surfaces 228 utilize a screw action while sliding against each other. The screw action produces a twist to the bolt 100 relative to the barrel extension 200, which is stationary once mounted on a firearm receiver. The extraction lugs 140 are configured to disengage the extraction cam surfaces 228 once the bolt head 120 is in the battery position. The bolt head 120 is configured to be locked into the passageway 210 of the barrel extension 200 once the rear surfaces 134 of the bolt head lugs 130 are engaged to the front surfaces 222 of the barrel extension lugs 220.

Figure 3A:
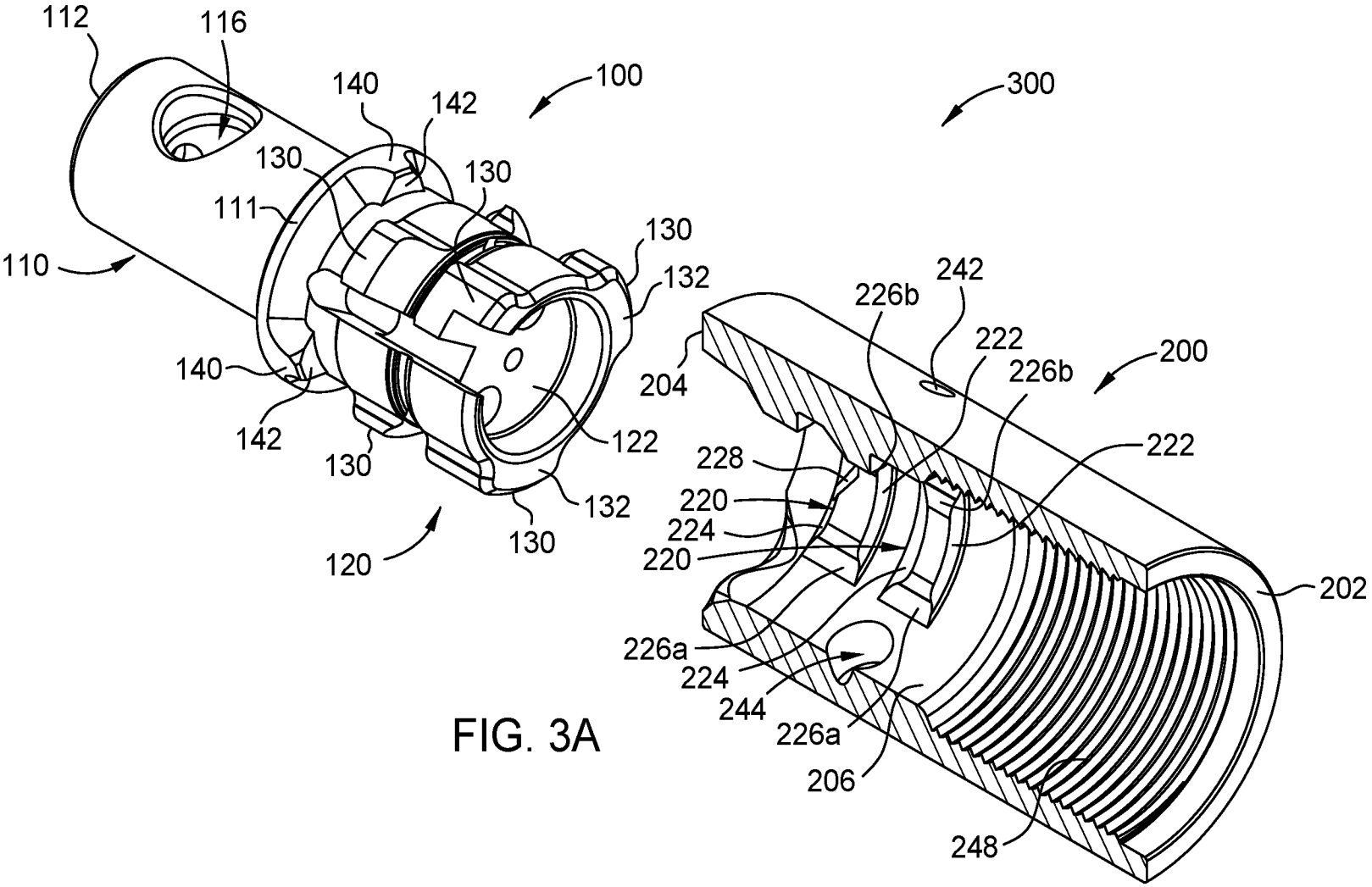
FIGS. 3A-3E depict a bolt extraction system containing the bolt as shown in FIG. 1A and the barrel extension as shown in FIG. 2A at different intervals of engaging each other, according to one or more embodiments described and discussed herein.
Figure 4:
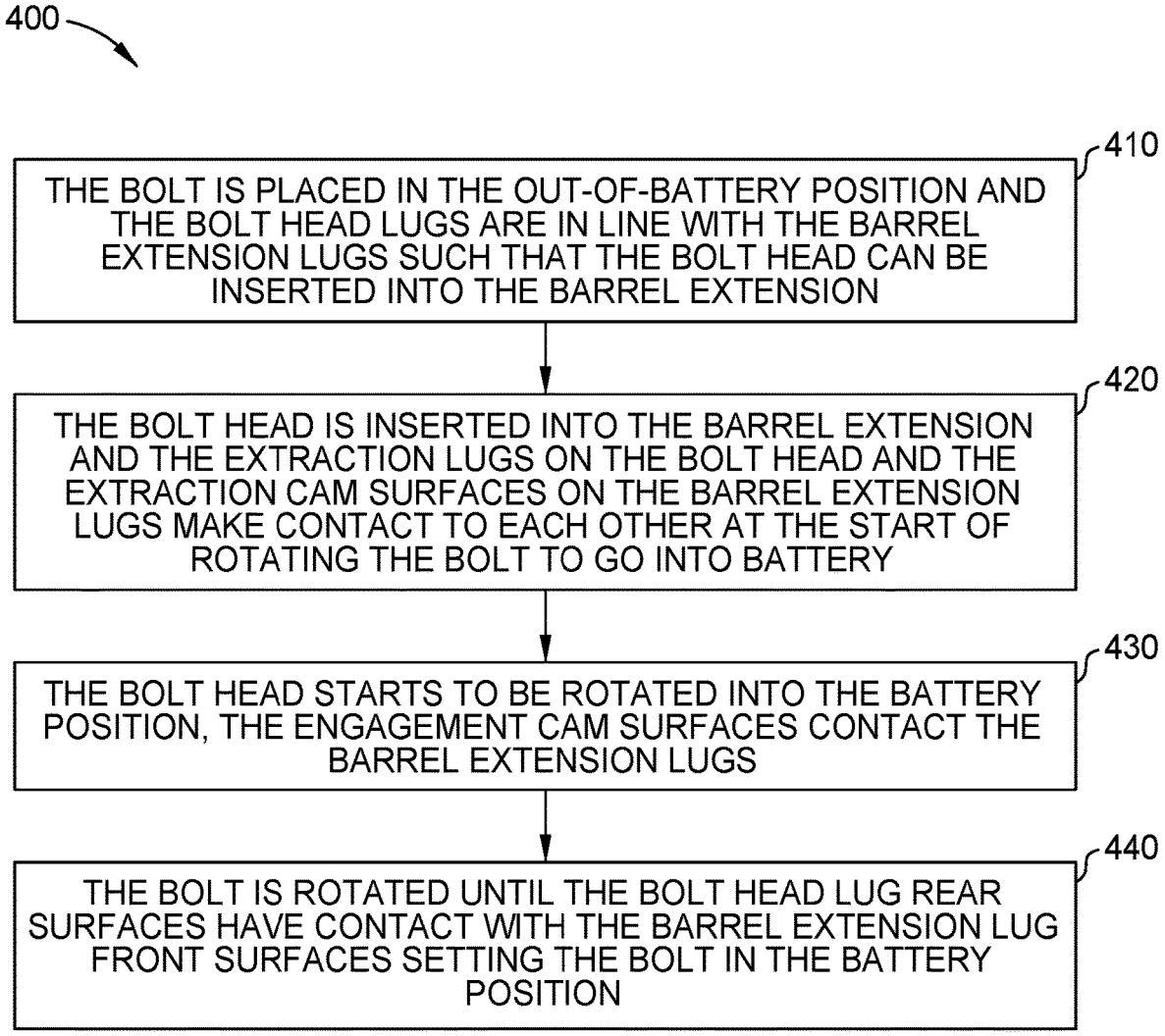
FIG. 4 is a flow chart illustrating the movement of the bolt while engaging the barrel extension at the different intervals illustrated in FIGS. 3A-3E, according to one or more embodiments described and discussed herein.

FIG. 3A depicts the bolt extraction system 300 containing the bolt 100 and the barrel extension 200 away from each other, but aligned with each other and placed in the out-of-battery position. This out-of-battery position is the typical how the bolt extraction system 300 either prior to loading a live cartridge into the breech or subsequent to removing a spent cartridge.

Figure 3B:
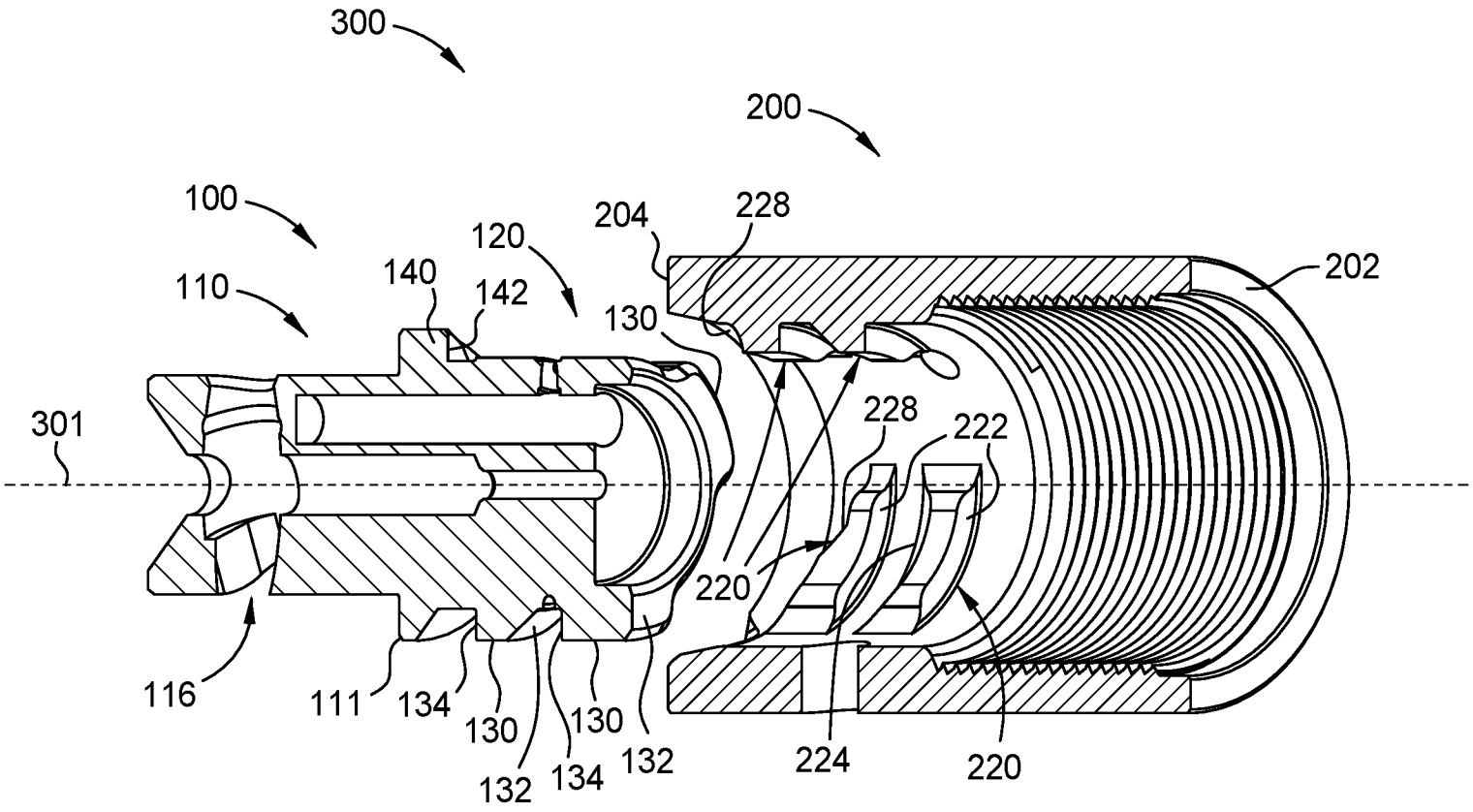

At operation 410 of the method 400, the bolt extraction system 300 has the bolt 100 placed in the out-of-battery position and the bolt head lugs 130 are in line with the barrel extension lugs 220 such that the bolt head 120 can be inserted into the barrel extension 200, as depicted in FIG. 3B.

Figure 3C:
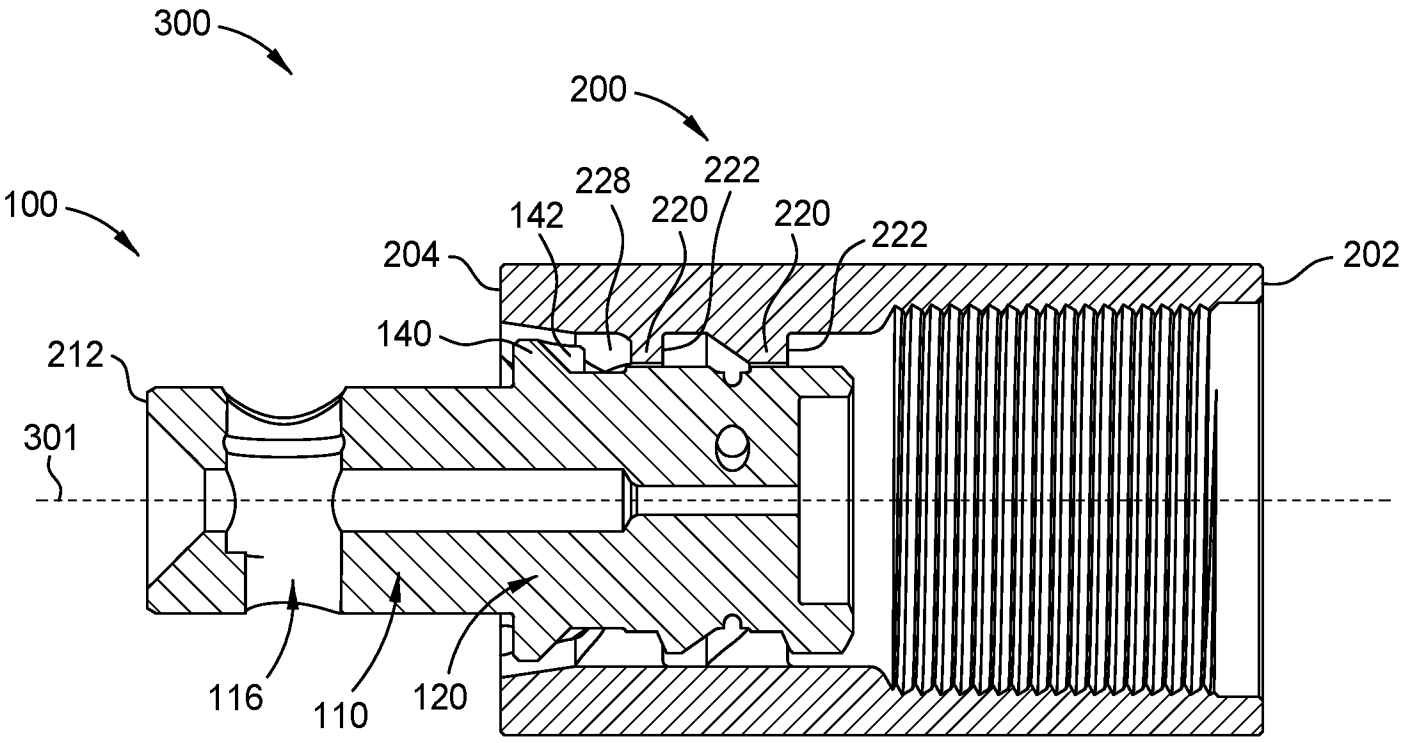

At operation 420 of the method 400, the bolt extraction system 300 has the bolt head 120 inserted into the barrel extension 200 and the extraction lugs 140 on the bolt head 120 and the extraction cam surfaces 228 on the barrel extension lugs 220 make contact to each other and starts the rotation of the bolt 100 to go into the battery position, as depicted in FIG. 3C. When the bolt head 120 is being removed the user rotates the bolt head 120 until the barrel extension lugs 220 contacts the extraction cam surfaces 228 which in turn pushes the bolt head 120 out of the barrel extension 200 in order to remove any stuck shell casings from the breech. The mechanic motion of twisting as the barrel extension lugs 220 contact the extraction cam surfaces 228 provides the torque for removing the stuck shell casing. The barrel extension lugs 220 contact the extraction cam surfaces 228 utilize a screw action to assist in the removal of the bolt head 120 from the barrel extension 200. The engagement cam surfaces 138 on the bolt head lugs 130 have the proper clearance with the barrel extension lugs 220.

Figure 3D:
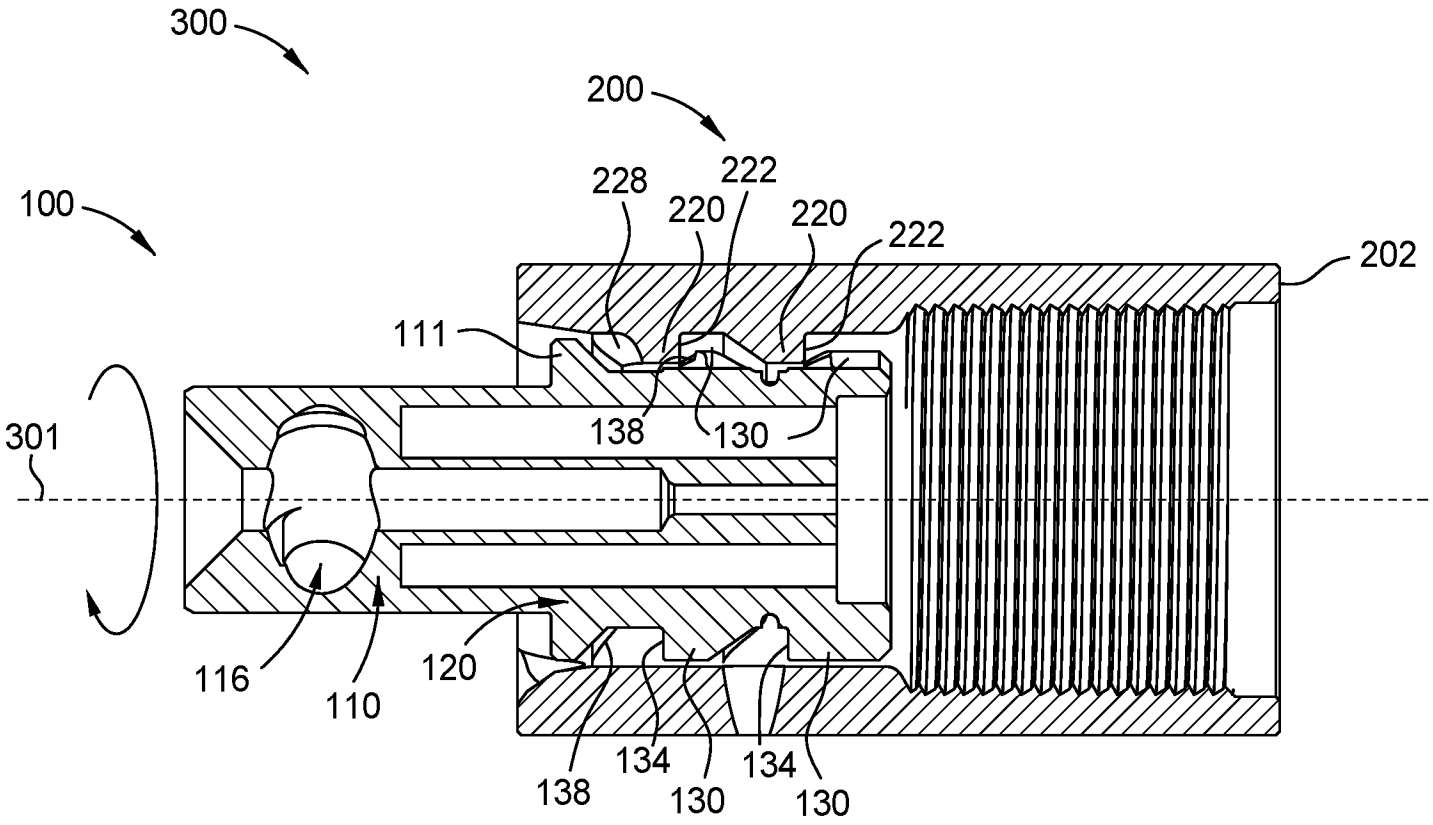

At operation 430 of the method 400, the bolt head 120 starts to be rotated into the battery position, the engagement cam surfaces 138 contact the barrel extension lugs 220, as depicted in FIG. 3D. As the bolt head 120 further rotates into the battery position, the engagement cam surfaces 138 assist to pull the bolt head 120 further into the barrel extension 200 to seat the shell casing into the breech and ensure the proper headspace is achieved. When rotating the bolt 100 into the out-of-battery position, the faces/surfaces of the barrel extension 200 and the bolt head lug 130 disengage as the engagement cam surfaces 138 provide the necessary clearance for the extraction lug 140 to properly function.

Figure 3E:
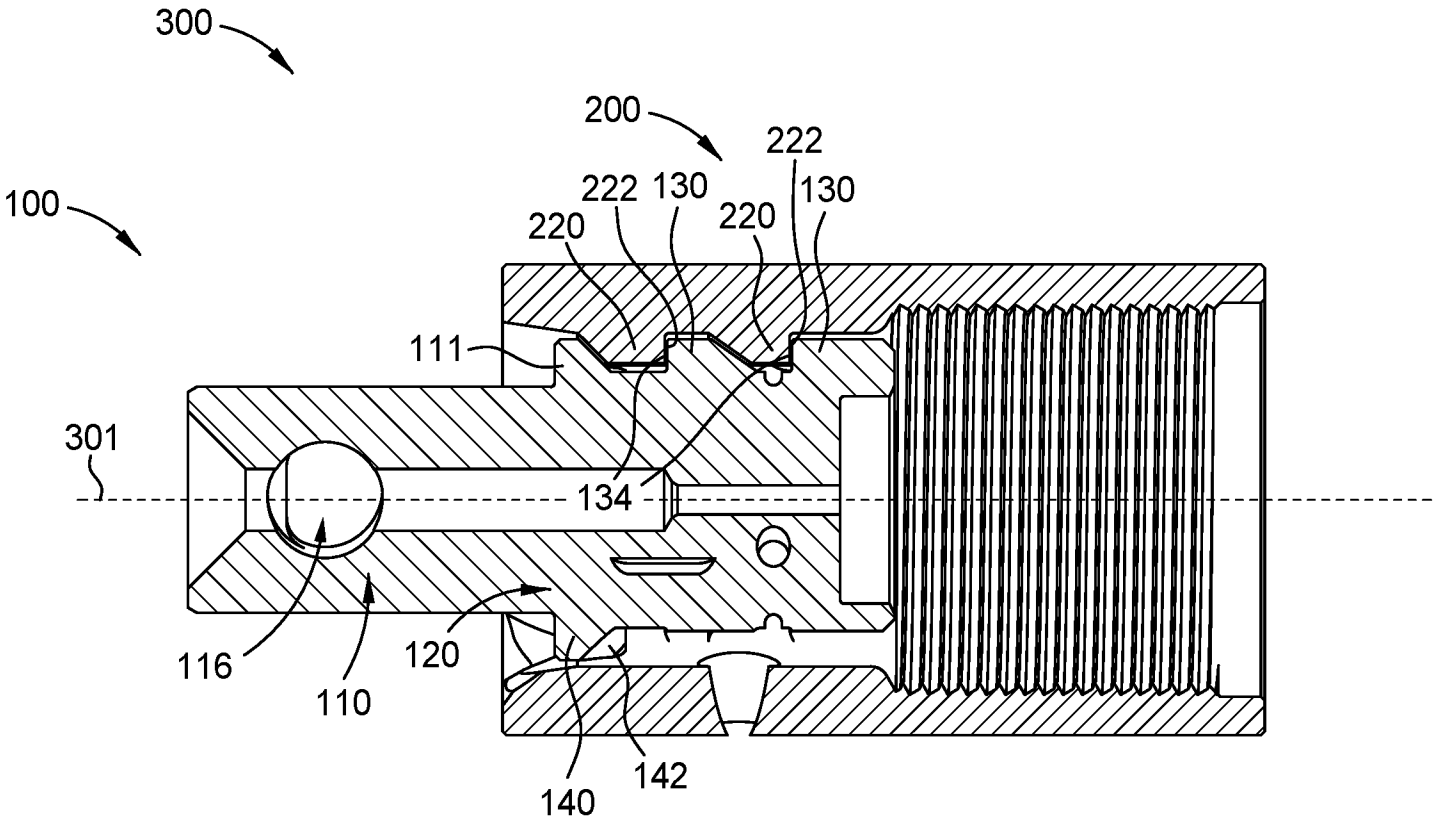

At operation 440 of the method 400, the bolt 100 is rotated until the faces/surfaces of bolt head lug 130 (e.g., the rear surfaces 134) have contact with the faces/surfaces of the barrel extension lugs 220 (e.g., the front surfaces 222) setting the bolt 100 into the battery position, as depicted in FIG. 3E.

In one or more embodiments, the method 400 of the movement of the bolt 100 while engaging the barrel extension 200 provides that the extraction lugs 140 are configured to: engage the extraction cam surfaces 228 while the bolt head 120 is in the out-of-battery position, slide along the extraction cam surfaces 228 while the bolt head 120 is rotated between the out-of-battery position and the battery position, and disengage the extraction cam surfaces 228 once the bolt head 120 is in the battery position.

In other embodiments, the bolt extraction system 300 for bolt-action rifles is provided and contains the bolt 100 and the barrel extension 200. The bolt 100 contains the bolt head 120 coupled to and axially aligned with the bolt tail 110 at the interface 108. The bolt head 120 contains the bolt face 122 which is relatively forward facing (e.g., point towards the muzzle of the rifle). The bolt face 122 is opposite of the tail surface 112 of the bolt tail 110. The bolt 100 further contains a plurality of bolt head lugs 130 and a plurality of extraction lugs 140. The plurality of bolt head lugs 130 is circumferentially disposed around the bolt head 120 and separated by gaps 128. Each of the bolt head lugs 130 contains the front surface 132 opposite the rear surface 134 and the first side surface 136*a* opposite the second side surface 146*b*. The plurality of extraction lugs 140 is circumferentially disposed around the bolt head 120. Each of the extraction lugs 140 has the front or engagement surface 142 which is forward facing and each of the extraction lugs 140 is circumferentially aligned with a respective gap 128 disposed between each pair of the bolt head lugs 130. The barrel extension 200 has the passageway 210 extending from the front side 202 to the rear side 204 of the barrel extension 200. The passageway 210 at the front side 202 is configured to accept a firearm barrel and the passageway 210 at the rear side 204 is configured to accept the bolt head 120. The barrel extension 200 further contains the plurality of barrel extension lugs 220 circumferentially disposed on the inner surface 206 of the barrel extension 200 within the passageway 210. Each of the barrel extension lugs 220 contains the extraction cam surface 228 which is rear facing. Each of the extraction cam surfaces 228 is circumferentially angled from the rear side 204 towards the front side 202 of the barrel extension 200.

Figure 5A:
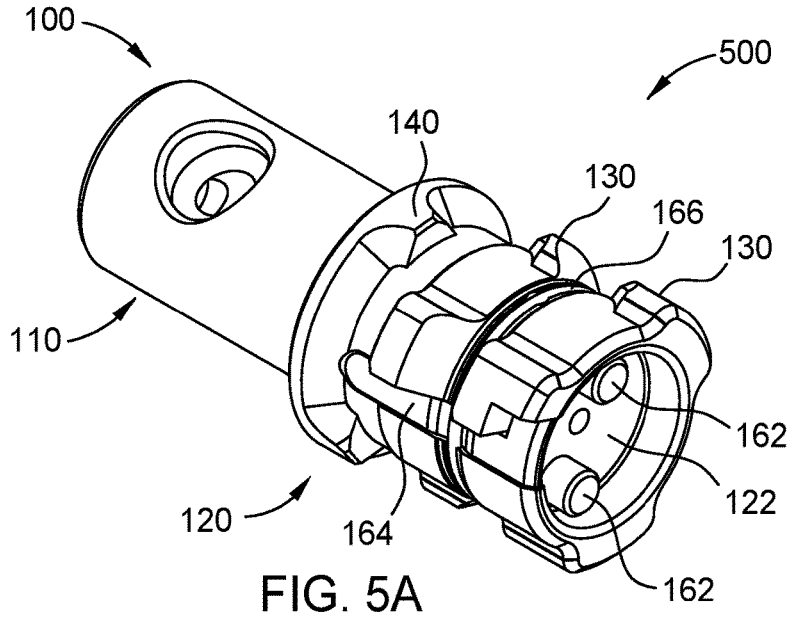
FIG. 5A depicts a perspective view of a bolt assembly, according to one or more embodiments described and discussed herein.
Figure 5B:
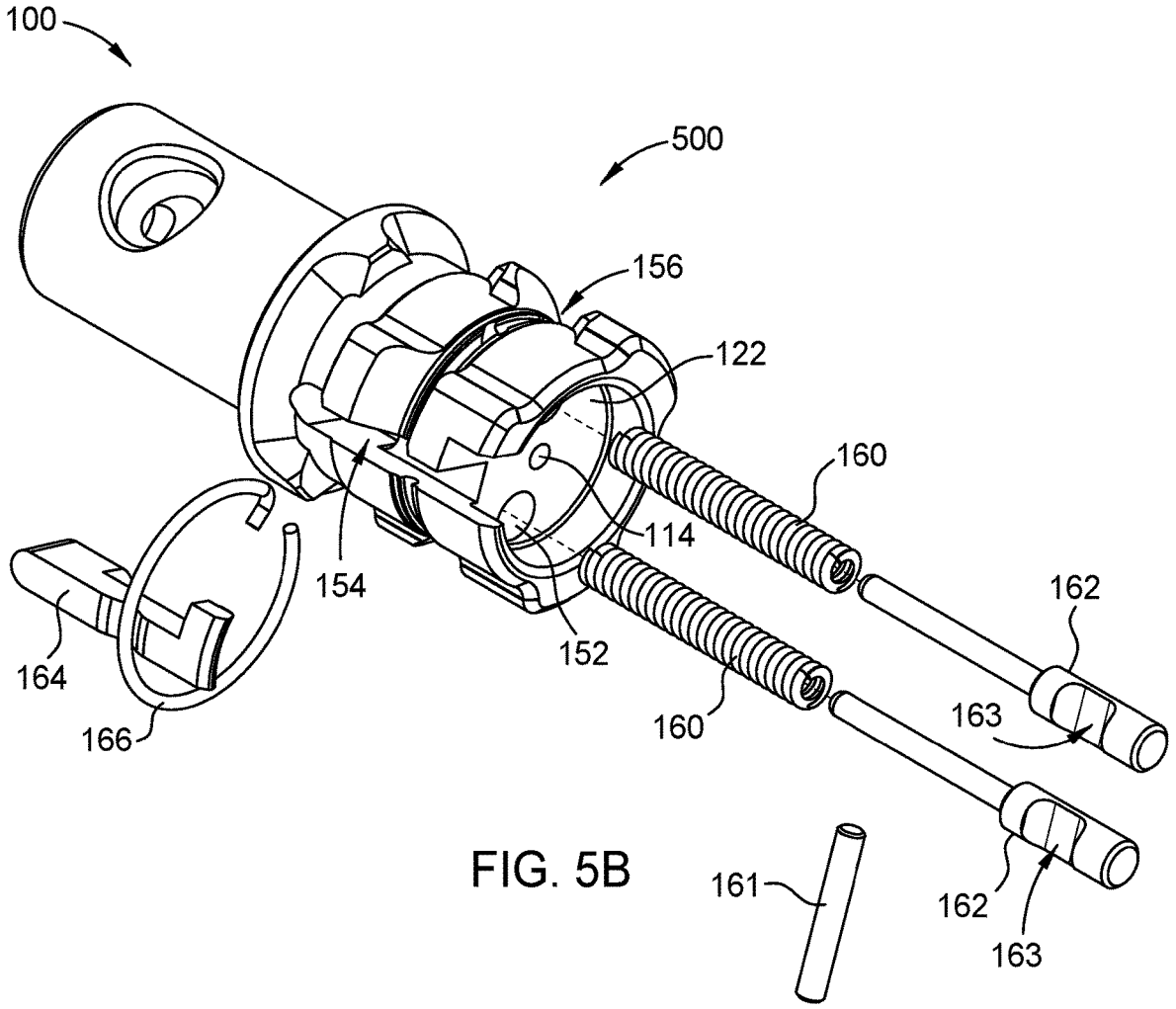
FIG. 5B depicts an exploded view of the bolt assembly shown in FIG. 5A, according to one or more embodiments described and discussed herein.

FIG. 5A depicts a perspective view of a bolt assembly 500 containing the bolt 100, according to one or more embodiments described and discussed herein. FIG. 5B depicts an exploded view of the bolt assembly 500. The bolt assembly 500 can be utilized in the bolt extraction system 300, as well as in numerous types of firearms including bolt-action rifles.

The bolt assembly 500 contains a variety of components disposed on and coupled to the bolt 100. The bolt assembly 500 contains an extractor 164 coupled to the bolt 100. The extractor 164 sets and conformally fits in the extractor slot 154 formed within the bolt 100. The extractor ring spring 166 encircles the bolt 100 and sets in a ring spring groove 156 formed within the bolt. The extractor ring spring 166 holds into place the extractor 164 and provides the extractor to radially move about the bolt face 122 while gripping and/or releasing the base of a cartridge or shell casing.

The bolt assembly 500 also contains one, two, or more ejectors 162 (two ejectors are shown in FIGS. 5A-5B). Each ejector 162 contains one or more springs 160 coupled along the shaft of the ejector 162. The springs 160 and the ejectors 162 are disposed within the ejector holes 152 formed through the bolt face 122 and into the bolt 100. The ejectors 162 are held to the bolt 100 by one or more pins 161 which pass through the ejector pin hole 153 (FIG. 1F) and fit within a slot 163 formed or otherwise contained on each ejector 162. The slot 163 is long enough to provide room for the ejectors 162 to move back and forth parallel to the central axis 101 of the bolt 100, which runs through the firing pin passageway 114.

Figure 6A:
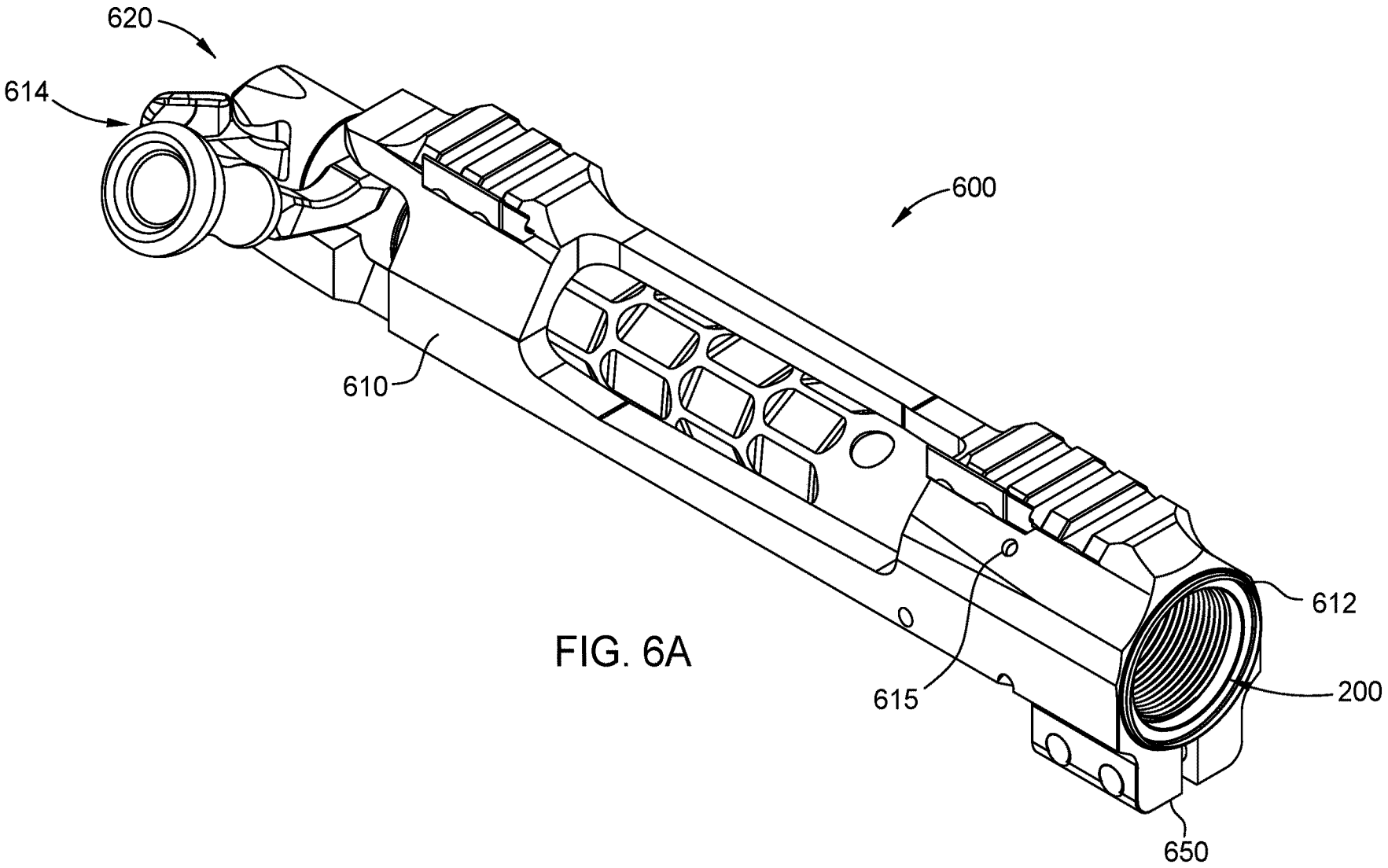
FIG. 6A depicts a perspective view of an action assembly, according to one or more embodiments described and discussed herein.
Figure 6B:
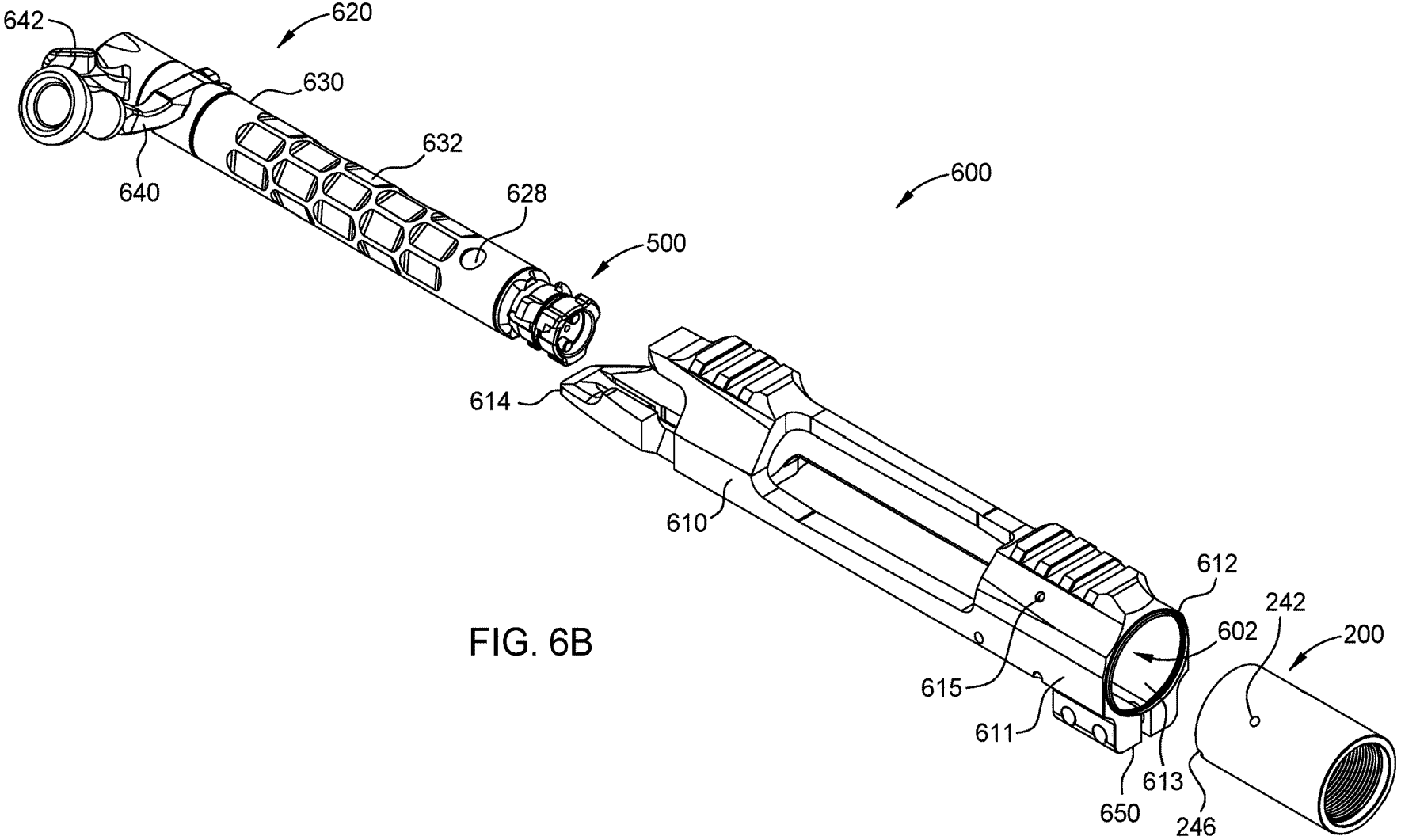
FIGS. 6B-6C depict exploded views of the action assembly shown in FIG. 6A, according to one or more embodiments described and discussed herein.
Figure 6C:
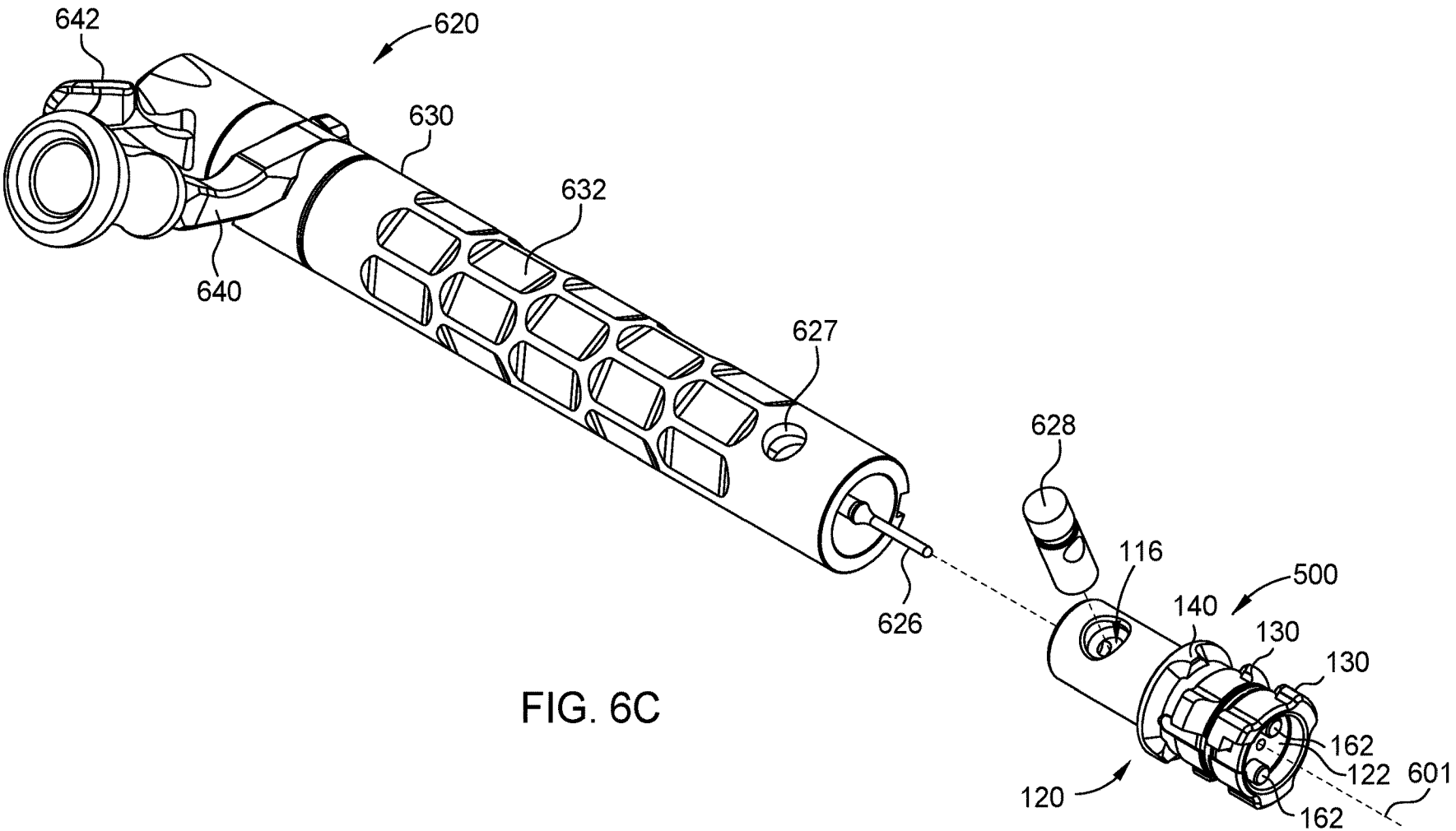

FIGS. 6A-6C depict an action assembly 600 for a bolt-action rifle and can be used with and/or include the bolt extraction system 300 which includes the bolt 100 and the barrel extension 200, as described and discussed herein. FIG. 6A depicts a perspective view of the action assembly 600, FIG. 6B depicts an exploded view of the action assembly 600, and FIG. 6C depicts an exploded view of the bolt carrier assembly 620 shown in FIG. 6B, according to one or more embodiments described and discussed herein.

The action assembly 600 contains a firearm receiver 610 and a bolt carrier assembly 620 positioned or otherwise disposed at least partially within the firearm receiver 610. The firearm receiver 610 contains a passageway 602 extending from at least a front side or portion 612 of the firearm receiver 610 to a rear side or portion 614 of the firearm receiver 610. The firearm receiver 610 can be made of or contain one or more metals, such as aluminum, aluminum alloy, steel, stainless steel, titanium, titanium alloy, magnesium, alloys thereof, or any combination thereof. In one or more examples, the firearm receiver 610 can be made of or contain one or more aluminum alloys, such as 7075 aluminum, 6061 aluminum, 6065 aluminum, alloys thereof, or combinations thereof.

The bolt carrier assembly 620 is configured to axially slide forward and backwards within the firearm receiver 610. The barrel extension 200 is contained within the passageway 602 at the front side or portion 612 of the firearm receiver 610. The bolt carrier assembly 620 enters and exits via the passageway 602 at the rear side or portion 614 of the firearm receiver 610. The bolt carrier assembly 620 is shown partially extending out of the rear side or portion 614 of the firearm receiver 610. The bolt carrier assembly 620 contains a bolt carrier 630 coupled to the bolt assembly 500 by a cam pin 628. The bolt carrier 630 is coupled to the bolt 100 via the cam pin 628 contained in the cam pin hole 116 formed within the bolt 100.

The bolt carrier assembly 620 contains a bolt handle 640 coupled to the bolt carrier 630, as well as a safety mechanism 642 and a firing pin 626, any other components and parts which make-up the bolt-action mechanism. In one or more embodiments, the bolt carrier 630 can be skeletonized and/or contain a plurality of formations 632 disposed along and/or around the body. The formations 632 can be or include skeletonization (e.g., skeletonized formation), scalloping, one or more flutes, engravings, cut-outs, depressions, or any combination thereof. The formations 632 reduce the weight of the bolt carrier 630 while maintaining the structural integrity of the bolt carrier 630.*f*

Figure 7:
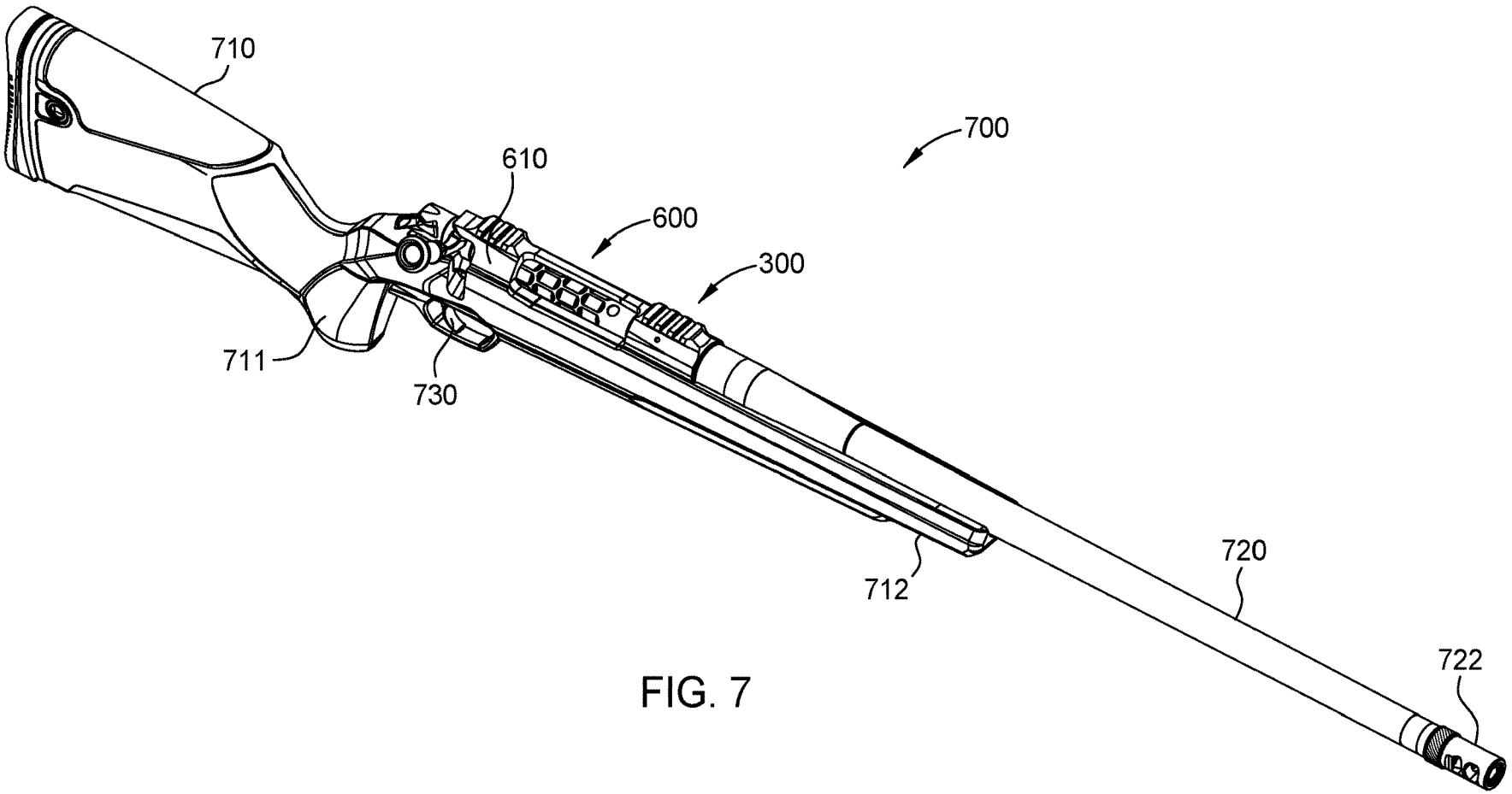
FIG. 7 depicts a perspective view of a bolt-action rifle containing the action assembly shown in FIG. 6A, according to one or more embodiments described and discussed herein.

FIG. 7 depicts a perspective view of a rifle 700, such as a bolt-action rifle, containing the action assembly 600 shown in FIG. 6A, according to one or more embodiments described and discussed herein. The rifle 700 contains the bolt extraction system 300 which includes the bolt 100 and the barrel extension 200. The barrel extension 200 is coupled to the firearm receiver 610 which contains the bolt 100. The barrel extension 200 can be coupled to the firearm receiver 610 with one, two, or more fasteners (e.g., screws, bolts, pins) via one or more attachment or threaded holes 244 and one or more attachment or alignment notches 246 (FIGS. 2A and 2C).

The rifle 700 contains a fire control mechanism 730 for firing or otherwise operating the rifle 700. The fire control mechanism 730 is coupled to the firearm receiver 610 and operable connected to the action assembly 600. The fire control mechanism 730 contains any needed parts or components for operating, firing, or engaging/disengaging safety of the rifle 700, such as a trigger, a sear, a hammer, one or more springs, one or more pins, and/or other parts.

In one or more embodiments, a barrel 720 is coupled to the front side 202 of the barrel extension 200. The barrel 720 can be threaded, pinned, friction-fitted, or otherwise attached to the barrel extension 200. For example, the barrel 720 can have matching threads and be threaded into the barrel extensions via the threading 248. In other embodiments, the barrel 720 and the barrel extension 200 are monolithic or otherwise a single piece. For example, the barrel extension 200 can be formed within the breech of the barrel 720, such as made from the same piece of metal or from two separate pieces of metal which are welded or forged together. The barrel 720 can optionally have a muzzle device 722, such as a brake, a flash hider, a sound dissipater, a thread protector, a sound suppressor, or other devise. Alternative, in other embodiments, the muzzle of the barrel 720 could have a crown without a muzzle device (not shown).

The rifle 700 contains a stock 710, a pistol grip 711, and/or a forearm 712 (including a handguard or a forend) coupled or otherwise attached to the firearm receiver 610. As shown in FIG. 7, the stock 710, the pistol grip 711, and the forearm 712 (e.g., forend) are all one monolithic piece or unit. In some embodiments, the stock 710 and the pistol grip 711 can be a monolithic piece or unit, while the forearm 712 is a separate piece or unit coupled to the firearm receiver 610 (not shown). In other embodiments, the stock 710, the pistol grip 711, and the forearm 712 are each a separate piece or unit independently coupled to the firearm receiver 610 (not shown). The forearm 712 typically contains bedding or a bedding material at least partially or completely contained within a bedding box formed or otherwise contained within an inner portion or compartment (not shown in FIG. 7) of the forearm 712.

Figure 8A:
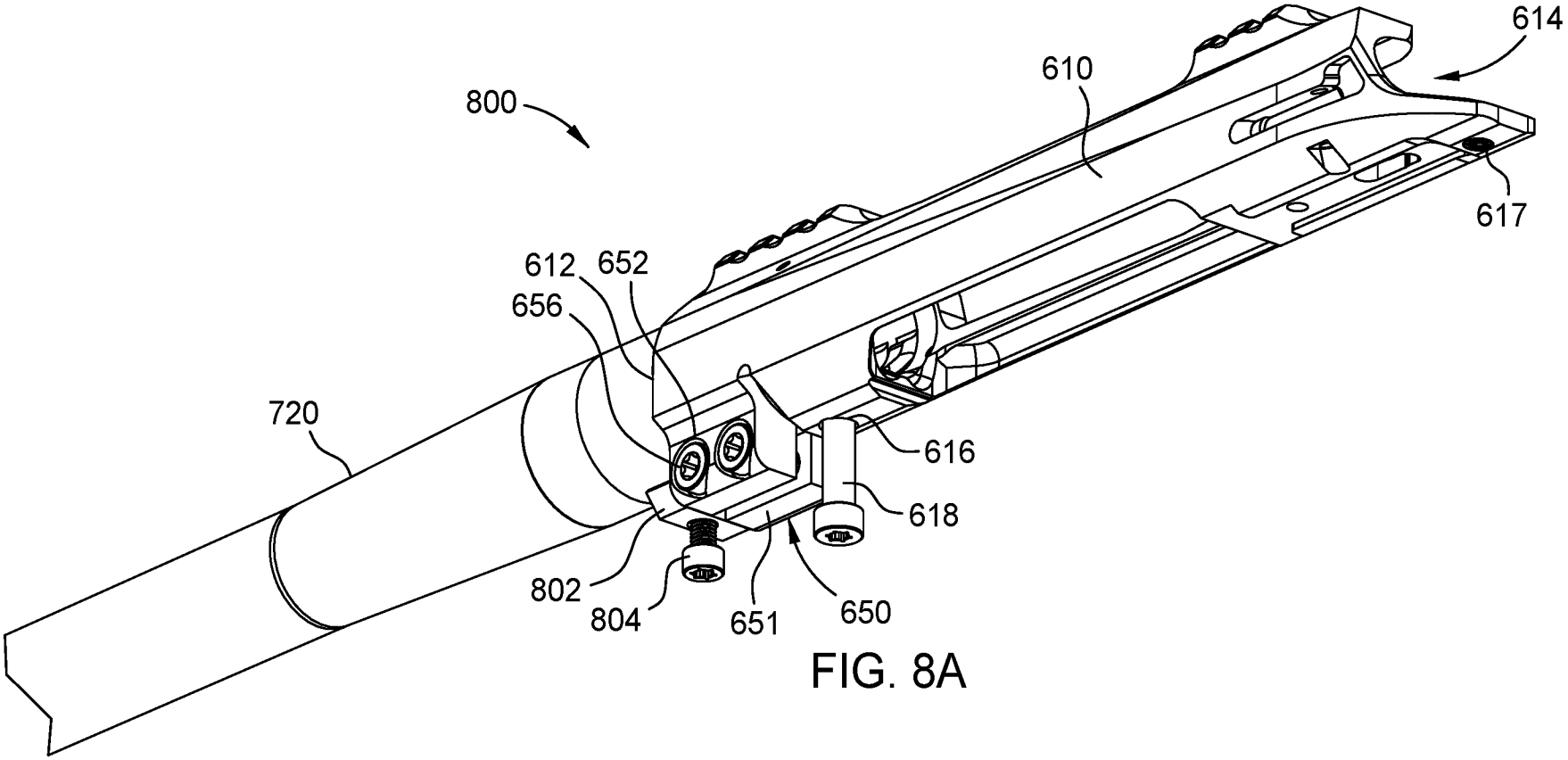
FIG. 8A depicts a perspective view of a barrel extension system, according to one or more embodiments described and discussed herein.
Figure 8B:
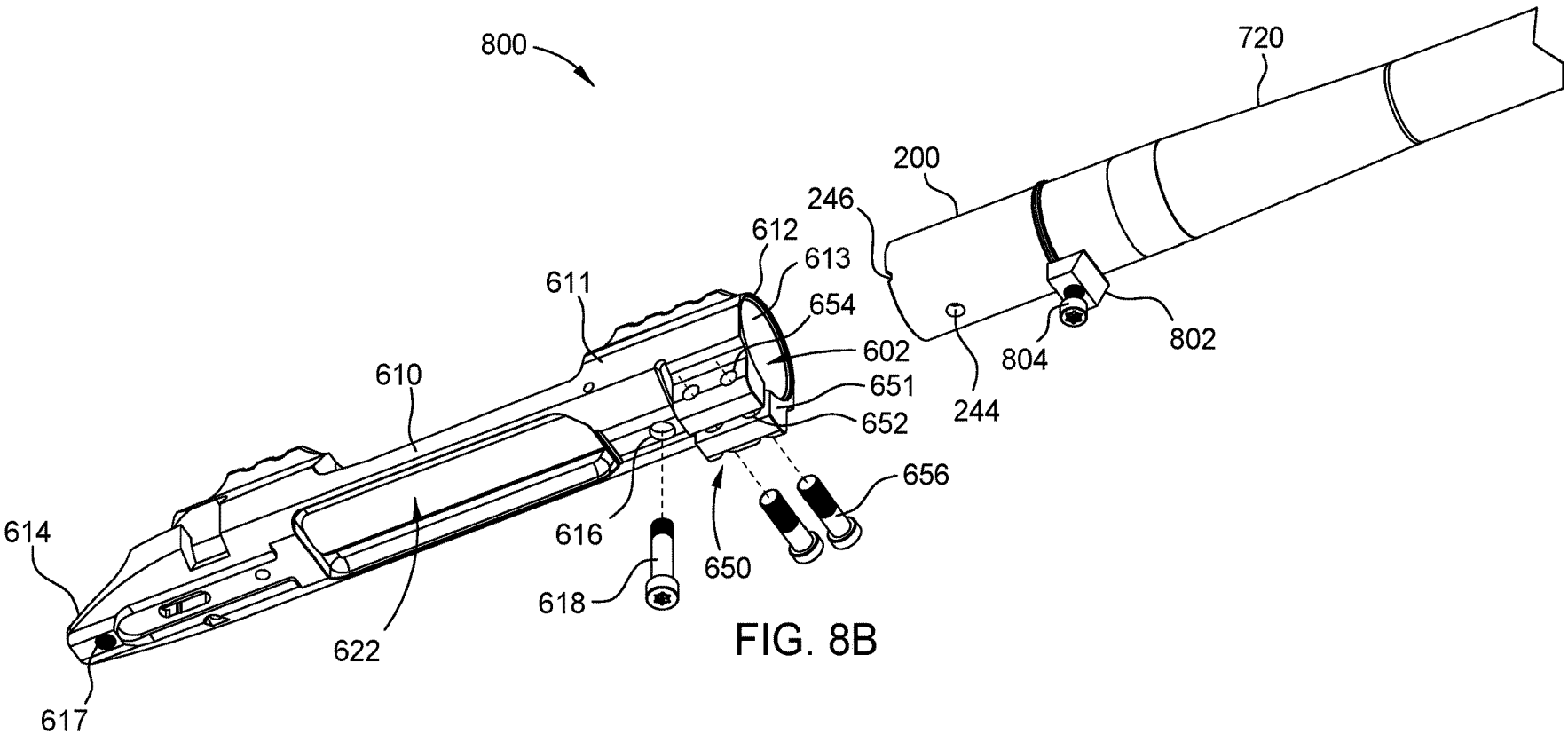
FIG. 8B depicts an exploded view of the barrel extension system shown in FIG. 8A, according to one or more embodiments described and discussed herein.
Figure 8C:
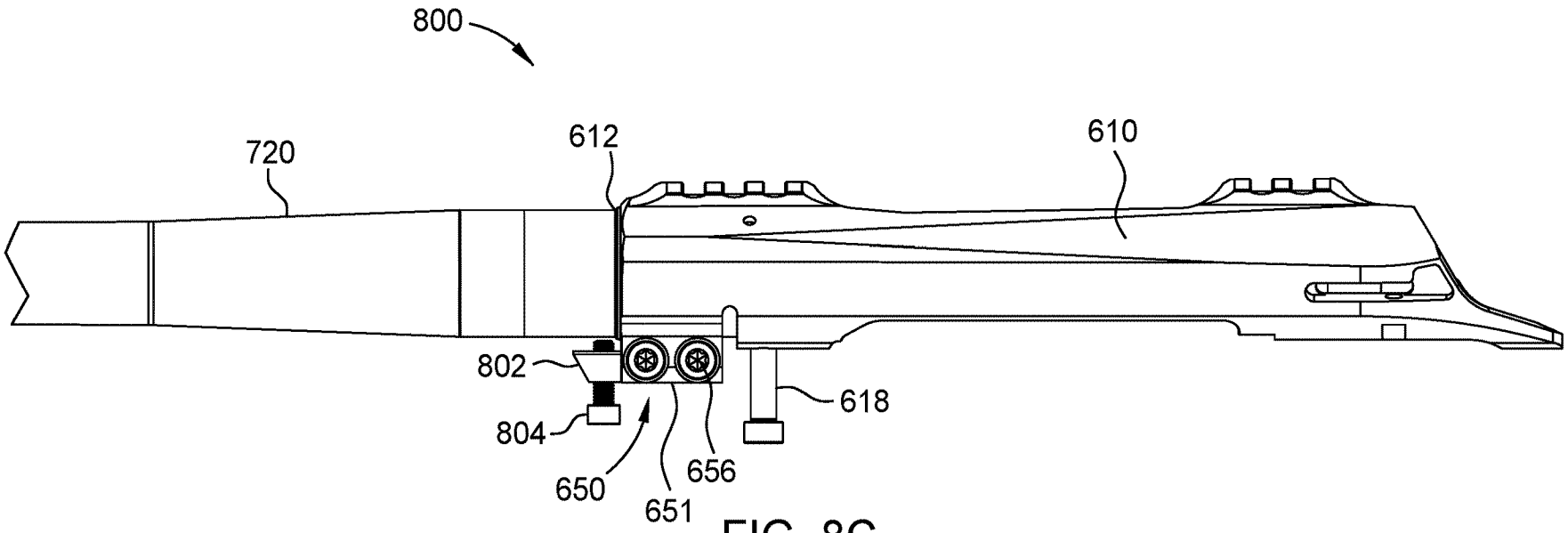
FIG. 8C depicts a side view of the barrel extension system shown in FIG. 8A, according to one or more embodiments described and discussed herein.
Figure 8D:
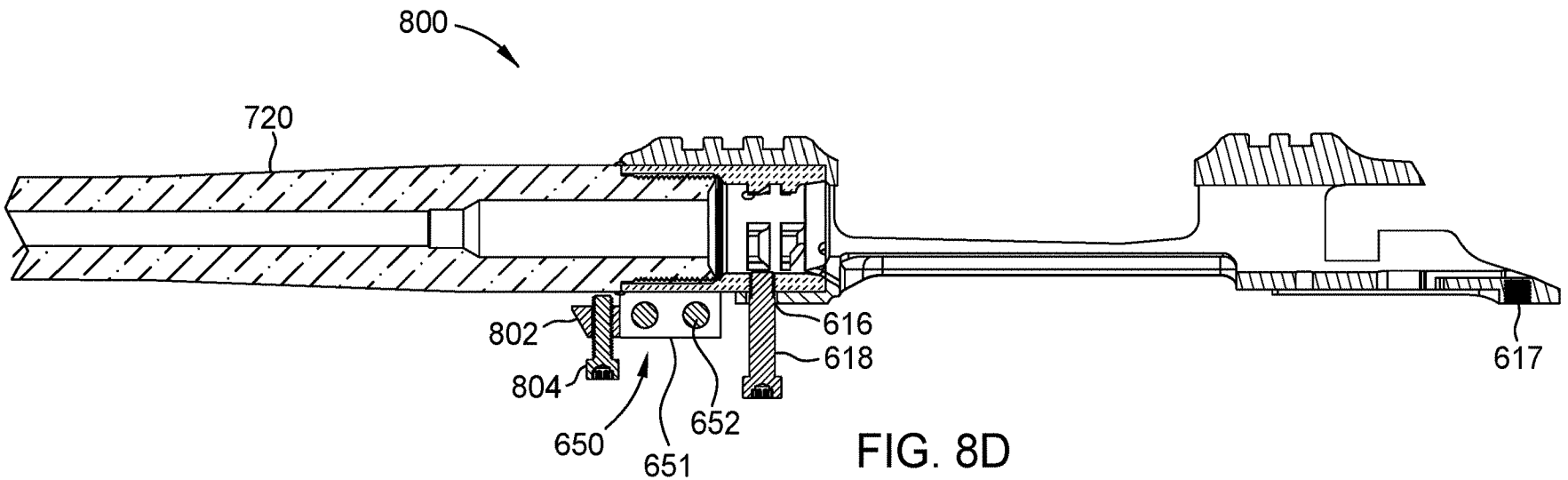
FIG. 8D depicts a cross-sectional side view of the barrel extension system shown in FIG. 8C, according to one or more embodiments described and discussed herein.

In one or more embodiments, a barrel extension system 800 for bolt-action rifles is provided and includes the barrel extension 200 (depicted in at least FIGS. 2A-3E) and the firearm receiver 610 (depicted in FIGS. 6A-6B and 7), as further described and discussed below and depicted in FIGS. 8A-9C. FIG. 8A depicts a perspective view of the barrel extension system 800, according to one or more embodiments described and discussed herein. FIG. 8B depicts an exploded view of the barrel extension system 800, FIG. 8C depicts a side view of the barrel extension system 800, and FIG. 8D depicts a cross-sectional side view of the barrel extension system 800, according to one or more embodiments described and discussed herein.

The barrel extension 200 contains the passageway 210 extending from the front side 202 to the rear side 204 of the barrel extension 200. The passageway 210 at the front side 202 is configured to accept a firearm barrel (e.g., the barrel 720) and the passageway 210 at the rear side 204 is configured to accept a bolt head (e.g., the bolt 100). The inner surface 206 of the passageway 210 of the barrel extension 200 adjacent the front side 202 is threaded and configured to accept the barrel 720.

The barrel extension 200 further includes a plurality of rear barrel extension lugs 220 and the attachment or threaded hole 244. The plurality of rear barrel extension lugs 220 is circumferentially disposed on the inner surface 206 of the barrel extension 200 within the passageway 210. Each of the rear barrel extension lugs 220 contains a front surface 222, a rear surface 224, and a first side surface 226*a* opposite a second side surface 226*b* (collectively, side surfaces 226). The attachment or threaded hole 244 is disposed on a lower portion of the barrel extension 200 and extending from the inner surface 206 of the barrel extension 200 to an outer surface 205 of the barrel extension 200. The firearm receiver 610 contains the passageway 602 extending from the front side or portion 612 to the rear side or portion 614 of the firearm receiver 610. The passageway 602 at the front side or portion 612 is configured to accept the barrel extension 200 and the passageway 602 at the rear side or portion 614 is configured to accept a bolt assembly. The firearm receiver 610 further contains a barrel extension clamp assembly 650. The barrel extension clamp assembly 650 is disposed on a lower portion of the firearm receiver 610 and disposed at the front side or portion 612 of the firearm receiver 610.

One or more attachment holes 616 (e.g., front action holes) and one or more attachment holes 617 (e.g., rear action holes) are disposed on the lower portion of the firearm receiver 610 and independently extend from an outer surface 611 of the firearm receiver 610 to the inner surface 613 of the firearm receiver 610, as depicted in FIGS. 6B, 8A-8D, and 9A-9B). The attachment hole 616 can be disposed between the barrel extension clamp assembly 650 and the rear side or portion 614 of the firearm receiver 610. If a magazine well is present, the attachment hole 616 can be disposed between the barrel extension clamp assembly 650 and a magazine well 622 formed in the lower portion of the firearm receiver 610. The magazine well 622 can be used for removal magazines, as well as fixed or internal magazines. The attachment hole 617 can be disposed between the magazine well 622 and the rear side or portion 614 of the firearm receiver 610.

The attachment hole 616 and the attachment or threaded hole 244 align with one another when the barrel extension 200 is positioned within the passageway 602 at the front side or portion 612 of the firearm receiver 610, as depicted in FIGS. 8A-8D. One or more fasteners 618 (e.g., bolt, screw, pin) are used to attach or otherwise couple the barrel extension 200 to the firearm receiver 610. The fastener 618 passes through the attachment hole 616 and screws into or otherwise couples to the attachment or threaded hole 244 for attaching the barrel extension 200 to the firearm receiver 610. In other embodiments, the barrel extension 200 can have one or more alignment notches 246 disposed on the rear side 204 of the barrel extension 200. In some examples, the attachment or alignment notch 246 mates or otherwise lines-up and contacts a pin, a bump, a feature, or the like (not shown) extending from the inner surface 613 of the firearm receiver 610.

The barrel extension clamp assembly 650 contains one, two, or more clamps 651 for gripping, holding, or otherwise coupling the barrel extension 200, at least in part, to the firearm receiver 610. In one or more embodiments, the barrel extension clamp assembly 650 contains one, two, or more clamps 651 which are monolithic with the firearm receiver 610, as depicted in the Figures. In other embodiments, not shown, the barrel extension clamp assembly 650 contains one, two, or more clamps 651 which are distinct, separable, or removable from the firearm receiver 610. In one or more configuration, each of the clamps 651 within the barrel extension clamp assembly 650 includes one or more holes 652 and one or more threaded holes 654, which are aligned to each other. A fastener 656 (e.g., bolt, screw, pin) passes through the hole 652 and screws into the threaded hole 654 The fastener is turned to tighten and loosen each of the one or more clamps 651. As such, the barrel extension 200 to the firearm receiver 610 are coupled together by a combination of the fastener 618 passing through the attachment hole 616 and screwed into the attachment or threaded hole 244, as well as the one or more fasteners 656 tightening the barrel extension clamp assembly 650 around the barrel extension 200.

In other embodiments, the plurality of rear barrel extension lugs 220 includes a first row of the rear barrel extension lugs 220 circumferentially disposed around the inner surface 206 of the barrel extension 200 within the passageway 210. The first row of the rear barrel extension lugs 220 contains two, three, or four barrel extension lugs 220. In one or more embodiments, each of the rear barrel extension lugs 220 contains an extraction cam surface 228 (as shown in in FIGS. 2A-2B). In some embodiments, each of the extraction cam surfaces 228 is circumferentially angled from a front surface 222 of the rear barrel extension lug 220 toward a rear surface 224 of the rear barrel extension lug 220 or toward the first or second side surface of the rear barrel extension lug 220. In other embodiments, each of the rear barrel extension lugs 220 lacks an extraction cam surface.

The barrel extension 200 can further include a plurality of front barrel extension lugs 220 circumferentially disposed on the inner surface 206 of the barrel extension 200 within the passageway 210. Each of the front barrel extension lugs 220 contains the front surface 222, the rear surface 224, and a first side surface 226*a* opposite a second side surface 226*b* (collectively, side surfaces 226). Also, the plurality of front barrel extension lugs 220 can include a second row of the front barrel extension lugs 220 circumferentially disposed around the inner surface 206 of the barrel extension 200 within the passageway 210. Each of the front barrel extension lugs 220 in the second row is aligned with a respective front barrel extension lug 220 in the first row. The second row of the front barrel extension lugs 220 contains two, three, or four barrel extension lugs 220.

The barrel extension 200 can further include a feed ramp 238 disposed on the rear side 204 of the barrel extension 200 (FIGS. 2A-2B). The feed ramp 238 extends from the inner surface 206 of the barrel extension 200 within the passageway 210 to the rear surface 204. The barrel extension 200 can further include one or more vent holes 242 extending through a sidewall of the barrel extension 200, such as extending through and between the outer surface 205 and the inner surface 206 of the barrel extension 200, as depicted in FIGS. 2A and 2F-2G. Also, the firearm receiver 610 contains one or more vent hole 615 which extends through and between the outer surface 611 and the inner surface 613 of the firearm receiver 610. Each vent hole 242 aligns with a respective vent hole 615, a pair of vent holes 242, 615 are shown throughout the Figures, such as FIGS. 6A-6B and 8A-8D.

Figure 9A:
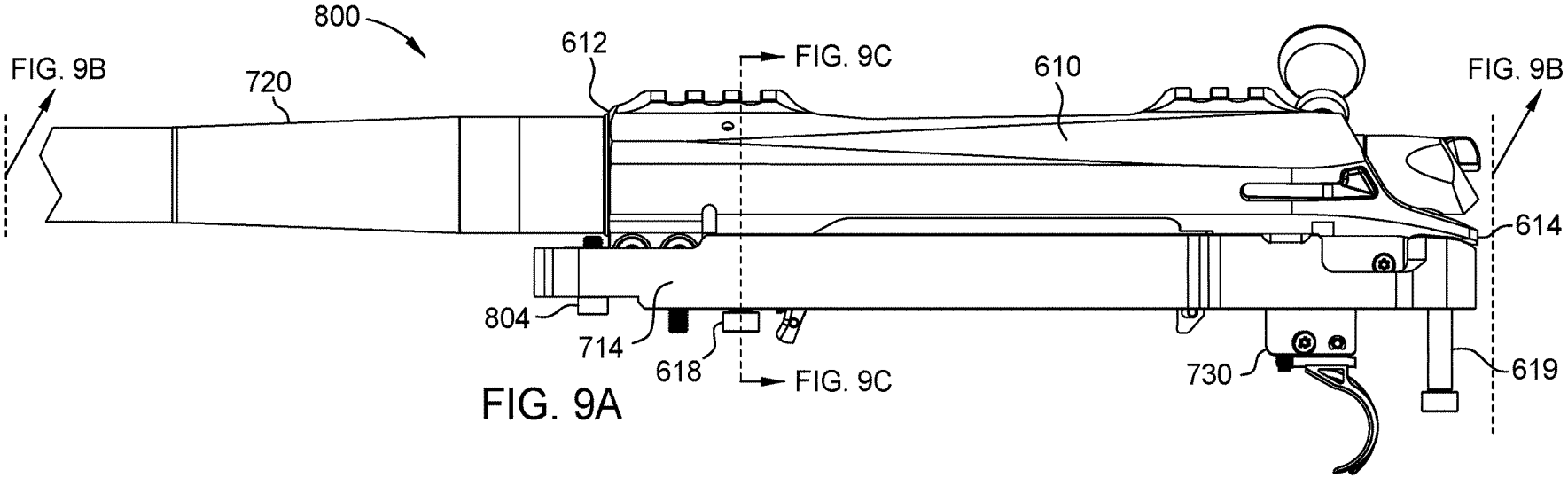
FIG. 9A depicts a side view of the barrel extension system shown in FIG. 8A and a portion of a rifle forearm, according to one or more embodiments described and discussed herein.
Figure 9B:
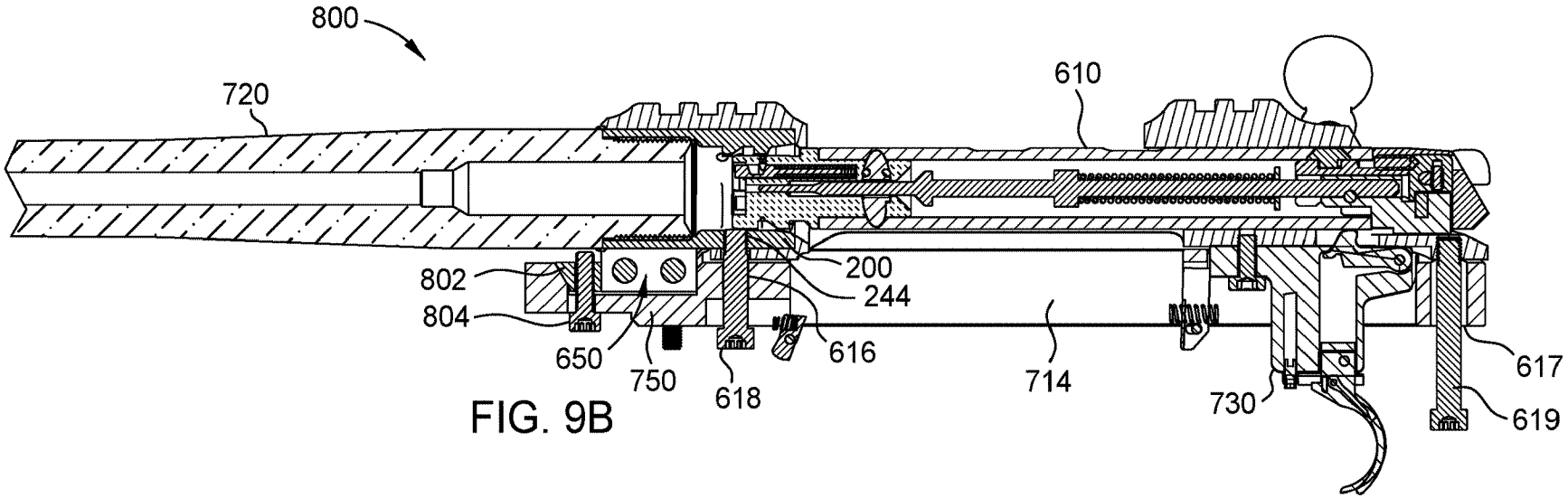
FIG. 9B depicts an angled, cross-sectional side view of the barrel extension system taken along line 9B-9B in FIG. 9A, according to one or more embodiments described and discussed herein.

FIG. 9A depicts a side view of the barrel extension system 800 and a rifle forearm portion 950, according to one or more embodiments described and discussed herein. FIG. 9B depicts an angled, cross-sectional side view of the barrel extension system 800 taken along line 9B-9B in FIG. 9A, and FIG. 9C depicts another cross-sectional view of the barrel extension system 800 taken along line 9C-9C in FIG. 9A, according to one or more embodiments described and discussed herein.

Figure 9C:
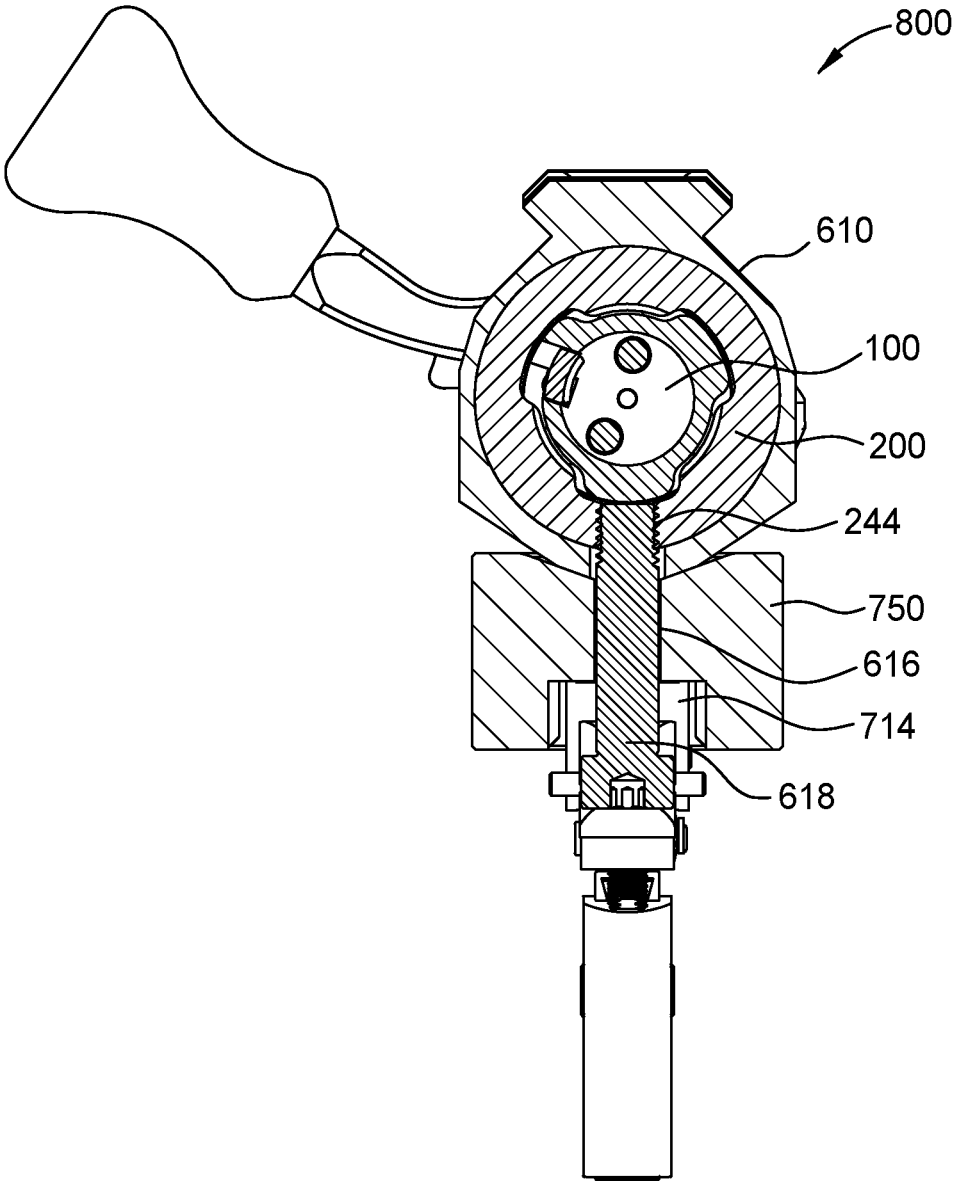
FIG. 9C depicts another cross-sectional view of the barrel extension system taken along line 9C-9C in FIG. 9A, according to one or more embodiments described and discussed herein.

The forearm 712 (shown in FIG. 7) typically contains a forearm segment 714 which attaches to the firearm receiver 610, as depicted in FIGS. 9A-9C. A portion of the forearm segment 714 contains a bedding 750 which includes one or more bedding materials, as depicted in FIGS. 9B-9C. The bedding 750 can be at least partially or completely contained within a bedding box formed or otherwise contained within an inner portion or compartment of the forearm segment 714. The forearm 712 and/or the forearm segment 714 can also include a forward recoil lug 802 coupled thereto and/or with the bedding by one or more fasteners 804 (e.g., bolt, screw, pin), as depicted in FIGS. 9A-9B.

In one or more embodiments, the bolt extraction system 300 and/or the barrel extension system 800 can independently be used on any type of rifle, such as a bolt-action rifle, as well as any type of length action receiver including long action receivers and short action receivers. In some examples, the bolt extraction system 300 and/or the barrel extension system 800 can independently be used on a Remington® Model 700 bolt-action rifle and is compatible with the Remington® Model 700 action system including systems with long action receivers and/or short action receivers. In some embodiments, the attachment holes 616, 617 are the front action hole and rear action hole, respectively, on a Remington® Model 700 type receiver or other brand receiver.

In one or more examples, the attachment holes 616, 617 are spaced apart and aligned on the bottom surface of the firearm receiver 610 at a distance within a range from about 7 inches to about 9 inches for a long action receiver and within a range from about 6 inches to about 7.5 inches for a short action receiver. In other examples, the attachment holes 616, 617 are spaced apart and aligned on the bottom surface of the firearm receiver 610 at a distance within a range from about 7.2 inches to about 7.8 inches for a long action receiver and within a range from about 6.2 inches to about 6.8 inches for a short action receiver. In some examples, the attachment holes 616, 617 are spaced apart and aligned on the bottom surface of the firearm receiver 610 at a distance of about 7.375 inches for a long action receiver and about 6.5 inches for a short action receiver.

One or more fasteners 618 (e.g., bolt, screw, pin) are used to attach or otherwise couple the barrel extension 200 to the firearm receiver 610. The fastener 618 passes through the attachment hole 616 and screws into or otherwise couples to the attachment or threaded hole 244 for attaching the barrel extension 200 to the firearm receiver 610.

One or more fasteners 619 (e.g., bolt, screw, pin) are used to attach or otherwise couple the forearm 712 (and/or the forearm segment 714) to the firearm receiver 610. The fastener 619 passes through the attachment holes (not shown) in the forearm 712 and screws into or otherwise couples to a threaded hole 617 for attaching the forearm 712 to the firearm receiver 610.

In one or more embodiments, a rifle 700, depicted in FIG. 7, such as a bolt-action rifle, contains the barrel extension system 800 as described and discussed herein. In some embodiments, the rifle 700 contains the barrel 720 coupled to the barrel extension 200 and the barrel extension 200 is coupled to the firearm receiver 610. In some configurations, the barrel 720 is threaded or pinned to the barrel extension 200. In other configurations, the barrel 720 and the barrel extension 200 are monolithically formed as a single piece of metal.

Embodiments of the present disclosure further relate to any one or more of the following examples 1-70:

1. A bolt extraction system for bolt-action rifles, comprising: a bolt comprising a bolt head coupled to and axially aligned with a bolt tail at an interface, wherein the bolt head comprises a bolt face, the bolt tail comprises a tail surface, and the bolt face is opposite of the tail surface, and wherein the bolt further comprises: a plurality of bolt head lugs circumferentially disposed around the bolt head and separated by gaps, wherein each of the bolt head lugs contains a front surface opposite a rear surface and a first side surface opposite a second side surface; and a plurality of extraction lugs circumferentially disposed around the bolt head at the interface, wherein each of the extraction lugs has a front surface opposite a rear surface and a first side surface opposite a second side surface, and wherein each of the extraction lugs is circumferentially aligned with a respective gap disposed between each pair of the bolt head lugs; and a barrel extension comprising a passageway extending from a front side to a rear side of the barrel extension, wherein the passageway at the front side is configured to accept a firearm barrel and the passageway at the rear side is configured to accept the bolt head, the barrel extension further comprises: a plurality of rear barrel extension lugs circumferentially disposed on an inner surface of the barrel extension within the passageway, wherein each of the rear barrel extension lugs contains a front surface, a rear surface, an extraction cam surface, and a first side surface opposite a second side surface.

2. The bolt extraction system according to example 1, wherein the plurality of bolt head lugs comprises a first row of the bolt head lugs circumferentially disposed around the bolt head.

3. The bolt extraction system according to example 1 or 2, wherein the first row of the bolt head lugs contains two, three, or four bolt head lugs.

4. The bolt extraction system according to any one of examples 1-3, wherein the first row of the bolt head lugs encircles the bolt face.

5. The bolt extraction system according to any one of examples 1-4, wherein the plurality of bolt head lugs comprises a second row of the bolt head lugs circumferentially disposed around the bolt head, and wherein each of the bolt head lugs in the second row is aligned with a respective bolt head lug in the first row and positioned further from the bolt face than the respective bolt head lug in the first row.

6. The bolt extraction system according to any one of examples 1-5, wherein the second row of the bolt head lugs contains two, three, or four bolt head lugs.

7. The bolt extraction system according to any one of examples 1-6, wherein the plurality of bolt head lugs comprises a third row of the bolt head lugs circumferentially disposed around the bolt head, and wherein each of the bolt head lugs in the third row is aligned with a respective bolt head lug in the second row and positioned further from the bolt face than the respective bolt head lug in the second row.

8. The bolt extraction system according to any one of examples 1-7, wherein each of the bolt head lugs further contains an engagement cam surface coupled to and between the rear surface and one of the first side surface or the second side surface.

9. The bolt extraction system according to any one of examples 1-8, wherein the plurality of extraction lugs contains two, three, or four extraction lugs.

10. The bolt extraction system according to any one of examples 1-9, wherein the plurality of extraction lugs is coupled to a bolt ring which encircles the bolt at the interface.

11. The bolt extraction system according to any one of examples 1-10, wherein an inner surface of the passageway of the barrel extension adjacent the front side is threaded and configured to accept a firearm barrel.

12. The bolt extraction system according to any one of examples 1-11, wherein the first side surface and the second side surface on each of the extraction lugs outwardly expands from the front surface to the rear surface on each of the extraction lugs.

13. The bolt extraction system according to any one of examples 1-12, wherein the plurality of rear barrel extension lugs comprises a first row of the rear barrel extension lugs circumferentially disposed around the inner surface of the barrel extension within the passageway.

14. The bolt extraction system according to any one of examples 1-13, wherein the first row of the rear barrel extension lugs contains two, three, or four barrel extension lugs.

15. The bolt extraction system according to any one of examples 1-14, further comprising a plurality of front barrel extension lugs circumferentially disposed on the inner surface of the barrel extension within the passageway, wherein each of the front barrel extension lugs contains a front surface opposite a rear surface and a first side surface opposite a second side surface.

16. The bolt extraction system according to any one of examples 1-15, wherein the plurality of front barrel extension lugs comprises a second row of the front barrel extension lugs circumferentially disposed around the inner surface of the barrel extension within the passageway.

17. The bolt extraction system according to any one of examples 1-16, wherein each of the front barrel extension lugs in the second row is aligned with a respective front barrel extension lug in the first row.

18. The bolt extraction system according to any one of examples 1-17, wherein the second row of the front barrel extension lugs contains two, three, or four barrel extension lugs.

19. The bolt extraction system according to any one of examples 1-18, wherein each of the extraction cam surfaces is circumferentially angled from the front surface of the rear barrel extension lug toward the rear surface of the rear barrel extension lug or toward the first or second side surface of the rear barrel extension lug.

20. The bolt extraction system according to any one of examples 1-19, wherein the bolt head is configured to be inserted into the passageway from the rear side of the barrel extension while in an out-of-battery position and the bolt head is configured to be locked into the passageway of the barrel extension while in a battery position.

21. The bolt extraction system according to any one of examples 1-20, wherein the extraction lugs are configured to engage the extraction cam surfaces while the bolt head is in the out-of-battery position.

22. The bolt extraction system according to any one of examples 1-21, wherein the extraction lugs are configured to slide along the extraction cam surfaces while the bolt head is rotated between the out-of-battery position and the battery position.

23. The bolt extraction system according to any one of examples 1-22, wherein the extraction lugs are configured to disengage the extraction cam surfaces once the bolt head is in the battery position.

24. The bolt extraction system according to any one of examples 1-23, wherein the bolt head is configured to be locked into the passageway of the barrel extension once the rear surfaces of the bolt head lugs are engaged to the front surfaces of the rear barrel extension lugs.

25. The bolt extraction system according to any one of examples 1-24, wherein the bolt further comprises a firing pin passageway axially extending from the bolt face to the tail surface.

26. The bolt extraction system according to any one of examples 1-25, wherein the bolt comprises iron, steel, stainless steel, carbon steel, tool steel, carpenter steel, titanium, titanium alloy, alloys thereof, or any combination thereof.

27. The bolt extraction system according to any one of examples 1-26, wherein the barrel extension comprises iron, steel, stainless steel, carbon steel, tool steel, carpenter steel, titanium, titanium alloy, alloys thereof, or any combination thereof.

28. The bolt extraction system according to any one of examples 1-27, further comprising a feed ramp disposed on the rear side of the barrel extension, wherein the feed ramp extends from the inner surface of the barrel extension within the passageway.

29. The bolt extraction system according to any one of examples 1-28, further comprising one or more vent holes extending through a sidewall of the barrel extension.

30. The bolt extraction system according to any one of examples 1-29, wherein the barrel extension has a cylindrical geometry.

31. A bolt assembly comprising the bolt according to any one of examples 1-30, further comprising: an extractor coupled to the bolt; and an ejector coupled to the bolt.

32. An action assembly for a bolt-action rifle comprising the bolt extraction system according to any one of examples 1-31, further comprising: a receiver; and a bolt carrier assembly disposed at least partially within the receiver, wherein the bolt carrier assembly comprises a bolt carrier coupled to the bolt.

33. A rifle comprising the bolt extraction system according to any one of examples 1-32, further comprising a firearm receiver comprising the bolt.

34. The rifle according to example 33, further comprising a barrel coupled to the barrel extension, wherein the barrel extension is coupled to the firearm receiver.

35. The rifle according to any one of example 33 or 34, wherein the barrel is threaded or pinned to the barrel extension.

36. The rifle according to any one of examples 33-35, wherein the barrel and the barrel extension are monolithically formed as a single piece of metal.

37. A bolt extraction system for bolt-action rifles, comprising: a bolt comprising a bolt head coupled to and axially aligned with a bolt tail, wherein the bolt head comprises a bolt face which is forward facing and the bolt tail comprises a tail surface, and the bolt face is opposite of the tail surface, and wherein the bolt further comprises: a plurality of bolt head lugs circumferentially disposed around the bolt head and separated by gaps, wherein each of the bolt head lugs contains a front surface opposite a rear surface and a first side surface opposite a second side surface; and a plurality of extraction lugs circumferentially disposed around the bolt head, wherein each of the extraction lugs has an engagement surface which is forward facing, and wherein each of the extraction lugs is circumferentially aligned with a respective gap disposed between each pair of the bolt head lugs; and a barrel extension comprising a passageway extending from a front side to a rear side of the barrel extension, wherein the passageway at the front side is configured to accept a firearm barrel and the passageway at the rear side is configured to accept the bolt head, the barrel extension further comprises: a plurality of barrel extension lugs circumferentially disposed on an inner surface of the barrel extension within the passageway, wherein each of the barrel extension lugs contains an extraction cam surface which is rear facing, and wherein each of the extraction cam surfaces is circumferentially angled from the rear side towards the front side of the barrel extension.

38. The bolt extraction system according to example 37, wherein the bolt head is configured to be inserted into the passageway from the rear side of the barrel extension while in an out-of-battery position and the bolt head is configured to be locked into the passageway of the barrel extension while in a battery position.

39. The bolt extraction system according to example 37 or 38, wherein the engagement surfaces of the extraction lugs are configured to engage the extraction cam surfaces of the barrel extension lugs while the bolt head is in the out-of-battery position.

40. The bolt extraction system according to any one of examples 37-39, wherein the engagement surfaces are configured to slide along the extraction cam surfaces while the bolt head is rotated between the out-of-battery position and the battery position.

41. The bolt extraction system according to any one of examples 37-40, wherein the engagement surfaces are configured to disengage the extraction cam surfaces once the bolt head is in the battery position.

42. The bolt extraction system according to any one of examples 37-41, wherein the bolt head is configured to be locked into the passageway of the barrel extension once the rear surfaces of the bolt head lugs are engaged to front surfaces of the rear barrel extension lugs.

43. A rifle, comprising: a receiver; a barrel; a barrel extension coupled to the receiver and the barrel; and a bolt assembly disposed in the receiver; wherein the bolt comprises a bolt head coupled to and axially aligned with a bolt tail, wherein the bolt head comprises a bolt face which is forward facing and the bolt tail comprises a tail surface, and the bolt face is opposite of the tail surface, and wherein the bolt further comprises: a plurality of bolt head lugs circumferentially disposed around the bolt head and separated by gaps, wherein each of the bolt head lugs contains a front surface opposite a rear surface and a first side surface opposite a second side surface; and a plurality of extraction lugs circumferentially disposed around the bolt head, wherein each of the extraction lugs has an engagement surface which is forward facing, and wherein each of the extraction lugs is circumferentially aligned with a respective gap disposed between each pair of the bolt head lugs; and wherein the barrel extension comprises a passageway extending from a front side to a rear side of the barrel extension, wherein the passageway at the front side is configured to accept a firearm barrel and the passageway at the rear side is configured to accept the bolt head, the barrel extension further comprises: a plurality of barrel extension lugs circumferentially disposed on an inner surface of the barrel extension within the passageway, wherein each of the barrel extension lugs contains an extraction cam surface which is rear facing, and wherein each of the extraction cam surfaces is circumferentially angled from the rear side towards the front side of the barrel extension.

44. A barrel extension system for bolt-action rifles, comprising: a barrel extension comprising a passageway extending from a front side to a rear side of the barrel extension, wherein the passageway at the front side is configured to accept a firearm barrel and the passageway at the rear side is configured to accept a bolt head, the barrel extension further comprises: a plurality of rear barrel extension lugs circumferentially disposed on an inner surface of the barrel extension within the passageway, wherein each of the rear barrel extension lugs contains a front surface, a rear surface, and a first side surface opposite a second side surface; and a threaded hole disposed on a lower portion of the barrel extension and extending from the inner surface of the barrel extension to an outer surface of the barrel extension; and a firearm receiver comprising a passageway extending from a front side to a rear side of the firearm receiver, wherein the passageway at the front side is configured to accept the barrel extension and the passageway at the rear side is configured to accept a bolt assembly, the firearm receiver further comprises: a clamp assembly disposed on a lower portion of the firearm receiver and disposed at the front side of the firearm receiver; and an attachment hole disposed on the lower portion of the firearm receiver, disposed between the clamp assembly and the rear side of the firearm receiver, and extending from an inner surface of the firearm receiver to an outer surface of the firearm receiver, wherein the attachment hole and the threaded hole align with one another when the barrel extension is positioned within the passageway at the front side of the firearm receiver.

45. The barrel extension system according to example 44, wherein the clamp assembly comprises one or more clamps which are monolithic with the firearm receiver.

46. The barrel extension system according to example 44 or 45, wherein the clamp assembly comprises one or more clamps which are distinct or removable from the firearm receiver.

47. The barrel extension system according to any one of examples 44-46, wherein the clamp assembly comprises one, two, or more fasteners configured to tighten and loosen each of the one or more clamps.

48. The barrel extension system according to any one of examples 44-47, further comprising a fastener configured to attach the barrel extension to the firearm receiver.

49. The barrel extension system according to any one of examples 44-48, wherein the fastener is configured to pass through the attachment hole and screw into the threaded hole for attaching the barrel extension to the firearm receiver.

50. The barrel extension system according to any one of examples 44-49, wherein the barrel extension comprises one or more alignment notches disposed on the rear side of the barrel extension.

51. The barrel extension system according to any one of examples 44-50, wherein the attachment hole is disposed between the clamp assembly and a magazine well formed in the lower portion of the firearm receiver.

52. The barrel extension system according to any one of examples 44-51, wherein an inner surface of the passageway of the barrel extension adjacent the front side is threaded and configured to accept a firearm barrel.

53. The barrel extension system according to any one of examples 44-52, wherein the plurality of rear barrel extension lugs comprises a first row of the rear barrel extension lugs circumferentially disposed around the inner surface of the barrel extension within the passageway.

54. The barrel extension system according to any one of examples 44-53, wherein the first row of the rear barrel extension lugs contains two, three, or four barrel extension lugs.

55. The barrel extension system according to any one of examples 44-54, further comprising a plurality of front barrel extension lugs circumferentially disposed on the inner surface of the barrel extension within the passageway, wherein each of the front barrel extension lugs contains a front surface opposite a rear surface and a first side surface opposite a second side surface.

56. The barrel extension system according to any one of examples 44-55, wherein the plurality of front barrel extension lugs comprises a second row of the front barrel extension lugs circumferentially disposed around the inner surface of the barrel extension within the passageway.

57. The barrel extension system according to any one of examples 44-56, wherein each of the front barrel extension lugs in the second row is aligned with a respective front barrel extension lug in the first row.

58. The barrel extension system according to any one of examples 44-57, wherein the second row of the front barrel extension lugs contains two, three, or four barrel extension lugs.

59. The barrel extension system according to any one of examples 44-58, wherein each of the rear barrel extension lugs comprises an extraction cam surface.

60. The barrel extension system according to any one of examples 44-59, wherein each of the extraction cam surfaces is circumferentially angled from the front surface of the rear barrel extension lug toward the rear surface of the rear barrel extension lug or toward the first or second side surface of the rear barrel extension lug.

61. The barrel extension system according to any one of examples 44-60, wherein the barrel extension comprises iron, steel, stainless steel, carbon steel, tool steel, carpenter steel, titanium, titanium alloy, alloys thereof, or any combination thereof.

62. The barrel extension system according to any one of examples 44-61, further comprising a feed ramp disposed on the rear side of the barrel extension, wherein the feed ramp extends from the inner surface of the barrel extension within the passageway.

63. The barrel extension system according to any one of examples 44-62, further comprising one or more vent holes extending through a sidewall of the barrel extension.

64. The barrel extension system according to any one of examples 44-63, wherein the barrel extension has a cylindrical geometry.

65. The barrel extension system according to any one of examples 44-64, wherein the firearm receiver comprises aluminum, aluminum alloy, steel, stainless steel, titanium, titanium alloy, magnesium, alloys thereof, or any combination thereof.

66. The barrel extension system according to any one of examples 44-65, wherein the firearm receiver comprises 7075 aluminum, 6061 aluminum, 6065 aluminum, alloys thereof, or combinations thereof.

67. A rifle comprising the barrel extension system according to any one of examples 44-66.

68. The rifle according to example 67, further comprising a barrel coupled to the barrel extension, wherein the barrel extension is coupled to the firearm receiver.

69. The rifle of according to example 67 or 68, wherein the barrel is threaded or pinned to the barrel extension.

70. The rifle of according to example 67 or 68, wherein the barrel and the barrel extension are monolithically formed as a single piece of metal.

While the foregoing is directed to embodiments of the disclosure, other and further embodiments may be devised without departing from the basic scope thereof, and the scope thereof is determined by the claims that follow. All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby. Likewise, whenever a composition, an element, or a group of elements is preceded with the transitional phrase "comprising", it is understood that the same composition or group of elements with transitional phrases "consisting essentially of", "consisting of", "selected from the group of consisting of", or "is" preceding the recitation of the composition, element, or elements and vice versa, are contemplated.

Certain embodiments and features have been described using a set of numerical minimum values and a set of numerical maximum values. It should be appreciated that ranges including the combination of any two values, e.g., the combination of any minimum value with any maximum value, the combination of any two minimum values, and/or the combination of any two maximum values are contemplated unless otherwise indicated. Certain minimum values, maximum values, and ranges appear in one or more claims below.

What is claimed is:

1. A bolt extraction system for bolt-action rifles, comprising:

a bolt comprising a bolt head coupled to and axially aligned with a bolt tail at an interface, wherein the bolt head comprises a bolt face, the bolt tail comprises a tail surface, and the bolt face is opposite of the tail surface, and wherein the bolt further comprises:

a plurality of bolt head lugs circumferentially disposed around the bolt head and separated by gaps, wherein each of the bolt head lugs contains a front surface opposite a rear surface and a first side surface opposite a second side surface; and a plurality of extraction lugs circumferentially disposed around the bolt head at the interface, wherein each of the extraction lugs has a front surface opposite a rear surface and a first side surface opposite a second side surface, and wherein each of the extraction lugs is circumferentially aligned with a respective gap disposed between each pair of the bolt head lugs; and a barrel extension comprising a passageway extending from a front side to a rear side of the barrel extension, wherein the passageway at the front side is configured to accept a firearm barrel and the passageway at the rear side is configured to accept the bolt head, the barrel extension further comprises:

a plurality of rear barrel extension lugs circumferentially disposed on an inner surface of the barrel extension within the passageway, wherein each of the rear barrel extension lugs contains a front surface, a rear surface, an extraction cam surface, and a first side surface opposite a second side surface.

2. The bolt extraction system of claim 1, wherein the plurality of bolt head lugs comprises a first row of the bolt head lugs circumferentially disposed around the bolt head, and wherein the first row of the bolt head lugs encircles the bolt face.

3. The bolt extraction system of claim 2, wherein the plurality of bolt head lugs comprises a second row of the bolt head lugs circumferentially disposed around the bolt head, and wherein each of the bolt head lugs in the second row is aligned with a respective bolt head lug in the first row and positioned further from the bolt face than the respective bolt head lug in the first row.

4. The bolt extraction system of claim 3, wherein the plurality of bolt head lugs comprises a third row of the bolt head lugs circumferentially disposed around the bolt head, and wherein each of the bolt head lugs in the third row is aligned with a respective bolt head lug in the second row and positioned further from the bolt face than the respective bolt head lug in the second row.

5. The bolt extraction system of claim 1, wherein each of the bolt head lugs further contains an engagement cam surface coupled to and between the rear surface and one of the first side surface or the second side surface.

6. The bolt extraction system of claim 1, wherein the first side surface and the second side surface on each of the extraction lugs outwardly expands from the front surface to the rear surface on each of the extraction lugs.

7. The bolt extraction system of claim 1, wherein the plurality of rear barrel extension lugs comprises a first row of the rear barrel extension lugs circumferentially disposed around the inner surface of the barrel extension within the passageway.

8. The bolt extraction system of claim 7, wherein each of the extraction cam surfaces is circumferentially angled from the front surface of the rear barrel extension lug toward the rear surface of the rear barrel extension lug or toward the first or second side surface of the rear barrel extension lug.

9. The bolt extraction system of claim 1, wherein the bolt head is configured to be inserted into the passageway from the rear side of the barrel extension while in an out-of-battery position and the bolt head is configured to be locked into the passageway of the barrel extension while in a battery position.

10. The bolt extraction system of claim 9, wherein the extraction lugs are configured to engage the extraction cam surfaces while the bolt head is in the out-of-battery position.

11. The bolt extraction system of claim 9, wherein the extraction lugs are configured to slide along the extraction cam surfaces while the bolt head is rotated between the out-of-battery position and the battery position.

12. The bolt extraction system of claim 9, wherein the extraction lugs are configured to disengage the extraction cam surfaces once the bolt head is in the battery position.

13. The bolt extraction system of claim 9, wherein the bolt head is configured to be locked into the passageway of the barrel extension once the rear surfaces of the bolt head lugs are engaged to the front surfaces of the rear barrel extension lugs.

14. A bolt extraction system for bolt-action rifles, comprising:

a bolt comprising a bolt head coupled to and axially aligned with a bolt tail, wherein the bolt head comprises a bolt face which is forward facing and the bolt tail comprises a tail surface, and the bolt face is opposite of the tail surface, and wherein the bolt further comprises:

a plurality of bolt head lugs circumferentially disposed around the bolt head and separated by gaps, wherein each of the bolt head lugs contains a front surface opposite a rear surface and a first side surface opposite a second side surface; and a plurality of extraction lugs circumferentially disposed around the bolt head, wherein each of the extraction lugs has an engagement surface which is forward facing, and wherein each of the extraction lugs is circumferentially aligned with a respective gap disposed between each pair of the bolt head lugs; and a barrel extension comprising a passageway extending from a front side to a rear side of the barrel extension, wherein the passageway at the front side is configured to accept a firearm barrel and the passageway at the rear side is configured to accept the bolt head, the barrel extension further comprises:

a plurality of barrel extension lugs circumferentially disposed on an inner surface of the barrel extension within the passageway, wherein each of the barrel extension lugs contains an extraction cam surface which is rear facing, and wherein each of the extraction cam surfaces is circumferentially angled from the rear side towards the front side of the barrel extension.

15. The bolt extraction system of claim 14, wherein the bolt head is configured to be inserted into the passageway from the rear side of the barrel extension while in an out-of-battery position and the bolt head is configured to be locked into the passageway of the barrel extension while in a battery position.

16. The bolt extraction system of claim 14, wherein the engagement surfaces of the extraction lugs are configured to engage the extraction cam surfaces of the barrel extension lugs while the bolt head is in the out-of-battery position.

17. The bolt extraction system of claim 14, wherein the engagement surfaces are configured to slide along the extraction cam surfaces while the bolt head is rotated between the out-of-battery position and the battery position.

18. The bolt extraction system of claim 14, wherein the engagement surfaces are configured to disengage the extraction cam surfaces once the bolt head is in the battery position.

19. The bolt extraction system of claim 14, wherein the bolt head is configured to be locked into the passageway of the barrel extension once the rear surfaces of the bolt head lugs are engaged to front surfaces of the rear barrel extension lugs.

20. A rifle, comprising:

a receiver;

a barrel;

a barrel extension coupled to the receiver and the barrel; and a bolt assembly disposed in the receiver;

wherein the bolt comprises a bolt head coupled to and axially aligned with a bolt tail, wherein the bolt head comprises a bolt face which is forward facing and the bolt tail comprises a tail surface, and the bolt face is opposite of the tail surface, and wherein the bolt further comprises:

a plurality of bolt head lugs circumferentially disposed around the bolt head and separated by gaps, wherein each of the bolt head lugs contains a front surface opposite a rear surface and a first side surface opposite a second side surface; and a plurality of extraction lugs circumferentially disposed around the bolt head, wherein each of the extraction lugs has an engagement surface which is forward facing, and wherein each of the extraction lugs is circumferentially aligned with a respective gap disposed between each pair of the bolt head lugs; and wherein the barrel extension comprises a passageway extending from a front side to a rear side of the barrel extension, wherein the passageway at the front side is configured to accept a firearm barrel and the passageway at the rear side is configured to accept the bolt head, the barrel extension further comprises:

a plurality of barrel extension lugs circumferentially disposed on an inner surface of the barrel extension within the passageway, wherein each of the barrel extension lugs contains an extraction cam surface which is rear facing, and wherein each of the extraction cam surfaces is circumferentially angled from the rear side towards the front side of the barrel extension.

* * * * *